US012655647B2

(12) United States Patent
Zeng et al.

(10) Patent No.: US 12,655,647 B2
(45) **Date of Patent: *Jun. 16, 2026**

(54) INFLATABLE MASSAGE POOL

(71) Applicant: BESTWAY INFLATABLES & MATERIAL CORP., Shanghai (CN)

(72) Inventors: Xianglin Zeng, Shanghai (CN); Yunzhe Ban, Shanghai (CN); Qingshui Song, Shanghai (CN); Chenggen Liu, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 266 days.

This patent is subject to a terminal disclaimer.

(21) Appl. No.: 18/386,873

(22) Filed: Nov. 3, 2023

(65) Prior Publication Data

US 2024/0191528 A1 Jun. 13, 2024

Related U.S. Application Data

(63) Continuation-in-part of application No. 18/208,614, filed on Jun. 12, 2023.

(30) Foreign Application Priority Data

| | | |
|---|---|---|
| Dec. 12, 2022 | (CN) | 202223334343.0 |
| Jun. 14, 2023 | (CN) | 202321526309.5 |
| Sep. 25, 2023 | (EP) | 23199386 |

(51) Int. Cl.
*E04H 4/00* (2006.01)

(52) U.S. Cl.
CPC ..... *E04H 4/0025* (2013.01)

(58) Field of Classification Search
CPC .... A47K 3/001; A47K 3/02–022; A47K 3/06; A61F 7/0053; A61H 33/60–6005;
(Continued)

(56) References Cited

U.S. PATENT DOCUMENTS 4,535,490 A * 8/1985 Wright ..... A47K 3/06 4/584
5,718,007 A 2/1998 Loyd
(Continued)

FOREIGN PATENT DOCUMENTS

CN 200980613 11/2007
CN 208319114 1/2019
(Continued)

OTHER PUBLICATIONS

Extended European Search Report dated Feb. 14, 2024 (Feb. 14, 2024), 7 pages, issued on related European Patent Application 23199386.6 by the European Patent Office.
(Continued)

*Primary Examiner* — David P Angwin
*Assistant Examiner* — Nicholas A Ros
(74) *Attorney, Agent, or Firm* — Dickinson Wright PLLC

(57) ABSTRACT

An inflatable pool is provided including: a pool body including a pool wall and a pool bottom which together define an inflatable chamber therein, and an accommodating cavity disposed within the pool wall and isolated from the inflatable chamber. A control box is disposed in the accommodating cavity.

15 Claims, 27 Drawing Sheets

(58) Field of Classification Search
CPC .. A61H 33/6021–6057; A61H 33/6063; B65D 88/16–1668; E04H 4/0018; E04H 4/0025; E04H 4/0056; E04H 4/1209; E04H 4/1245; E04H 4/1272–1281; E04H 4/14
See application file for complete search history.

(56) References Cited

U.S. PATENT DOCUMENTS

| | | | | |
|---|---|---|---|---|
| 6,357,059 | B1 * | 3/2002 | Lau | E04H 4/0025 4/541.1 |
| 6,978,494 | B2 * | 12/2005 | Wu | E04H 4/0025 4/585 |
| 11,808,053 | B2 * | 11/2023 | Huang | E04H 4/0025 |
| 2008/0141449 | A1 * | 6/2008 | Ren | A61H 33/60 601/154 |
| 2009/0241252 | A1 * | 10/2009 | Li | A61H 33/02 4/541.1 |
| 2018/0055685 | A1 * | 3/2018 | Campos | A61B 18/02 |

FOREIGN PATENT DOCUMENTS

| | | | | |
|---|---|---|---|---|
| CN | 109424221 | | 3/2019 | |
| CN | 209437123 | * | 9/2019 | A47K 3/06 |
| EP | 4006268 | A1 | 6/2022 | |

OTHER PUBLICATIONS

Extended European Search Report regarding corresponding EP App. No. 25168024.5; dated Jul. 14, 2025; 8 pgs.

* cited by examiner

INFLATABLE MASSAGE POOL

CROSS-REFERENCE TO RELATED APPLICATION

This Application claims the benefit of U.S. application Ser. No. 18/208,614, filed Jun. 12, 2023, which claims priority from Chinese Application 202223334343.0, filed Dec. 12, 2022 in China; this Application further claims priority from Chinese Application CN202321526309.5, filed Jun. 14, 2023 in China; this Application further claims priority from European Application EP23199386.6, filed Sep. 25, 2023; the disclosures of all of these Applications are incorporated herein by reference in their entireties.

BACKGROUND

1. Field

Example embodiments relate to above-ground pools, and in particular to an inflatable massage pool.

2. Description of Related Art

A portable massage (SPA) pool is a standalone pool holding warm or hot water in which one or more people may be partially immersed. A massage pool product of the existing design comprises an inflatable SPA pool having a massage function, which has an inflatable pool body, with an inner wall or a bottom portion of the body being provided with a massage nozzle that can spray air or water to achieve a local massage function. Existing inflatable massage pools in the market generally have a control box placed next to the pool. The control box is generally equipped with a water pump, a heater, an air pump, etc., so as to achieve functions of filtering, heating and massage. Such a control box is usually placed outside a pool body of the massage pool. More specifically, the massage control box and the pool body are usually arranged separately, occupying a large area during use. Furthermore, existing inflatable massage pools are complicated for installation and inconvenient for operation for a user.

SUMMARY

Example embodiments may address at least the above problems and/or disadvantages and other disadvantages not described above. Also, example embodiments are not required to overcome the disadvantages described above, and may not overcome any of the problems described above.

According to an aspect of an example embodiment, an inflatable pool comprises: a pool body comprising: a pool wall and a pool bottom which together define an inflatable chamber therein, and an accommodating cavity disposed within the pool wall and isolated from the inflatable chamber; and a control box disposed in the accommodating cavity.

The pool wall may comprise a top wall, an outer wall, and an inner wall; and the pool body may further comprise an accommodating wall disposed within the pool wall and separating the accommodating chamber from the inflatable chamber, the accommodating wall connected to the inner wall and to the outer wall.

The accommodating wall may comprise an upper wall portion disposed substantially parallel to the top wall of the pool wall.

The accommodating wall may comprise a side wall portion shaped to surround the control box.

The pool body may further comprise a protective wall disposed between the accommodating wall and the control box, wherein the protective wall is connected to the outer wall and to the inner wall.

The pool wall may comprise an opening in the pool bottom through which the control box may be inserted.

The control box may comprise a control panel, and the pool wall may comprise an opening therein through which the control panel extends from an interior of the accommodating chamber.

The pool wall may comprise a pool wall water inlet and a pool wall water outlet; the control box may comprise: a control box water inlet, in communication with the pool wall water inlet, and a control box water outlet, in communication with the pool wall water outlet; and the control box may be configured to circulate water in a water receptacle, defined by the pool wall and the pool bottom, via the control box water inlet, the pool wall water inlet, the control box water outlet, and the pool wall water outlet.

The inflatable pool may further comprise: a water outlet sealing assembly sealing the pool wall water outlet to the control box water outlet; the control box may further comprise a control box water outlet connector; the pool body may further comprise a back hole formed through the accommodating wall and a pool water outlet connector extending through the inner wall and extending through the back hole; and the pool wall water outlet connector may be sealed to the control box water outlet connector by the water outlet sealing assembly.

The inflatable pool may further comprise: a water inlet sealing assembly sealing the pool wall water inlet to the control box water inlet; the control box may comprise a control box water inlet connector; the pool body may comprise a back hole formed through the accommodating wall and a pool water inlet connector extending through the inner wall and extending through the back hole; and the pool water inlet connector may be sealed to the control box water inlet connector by the water inlet sealing assembly.

The pool wall may comprise a pool wall air inlet; the control box may comprise a control box air inlet in communication with the pool wall air inlet; and the control box may be configured to supply air into a water receptacle, defined by the pool wall and the pool bottom, via the control box air inlet and the pool wall air inlet.

The inflatable pool may further comprise: an air inlet sealing assembly sealing the pool wall air inlet to the control box air inlet; the control box may further comprise a control box air inlet connector; the pool wall may further comprise a back hole formed through the accommodating wall and pool wall air inlet connector extending through the back hole; and the pool air inlet connector may be sealed to the control box air inlet connector by the air inlet sealing assembly.

The inflatable pool may further comprise: an inflation sealing assembly; the control box may comprise a control box inflation connector; and the accommodating wall may comprise an accommodating cavity inflation connector sealed to the control box inflation connector via the inflation sealing assembly.

The accommodating cavity inflation connector may comprise a first connection part; and the control box inflation connector may comprise an inflation insertion end sleeved into the first connection part such that an inner wall of the first connection part is sealed to an outer wall of the inflation insertion end.

The inflation sealing assembly may comprise: a first inflation clamping groove formed in the inner wall of the first connection part, a first inflation sealing ring disposed in the first inflation clamping groove, a second inflation clamping groove formed in the outer wall of the inflation insertion end, and a second inflation sealing ring disposed in the second inflation clamping groove.

BRIEF DESCRIPTION OF THE DRAWINGS

The above and/or other aspects will become apparent and more readily appreciated from the following description of example embodiments, taken in conjunction with the accompanying drawings, in which.

DETAILED DESCRIPTION

Figure 1:
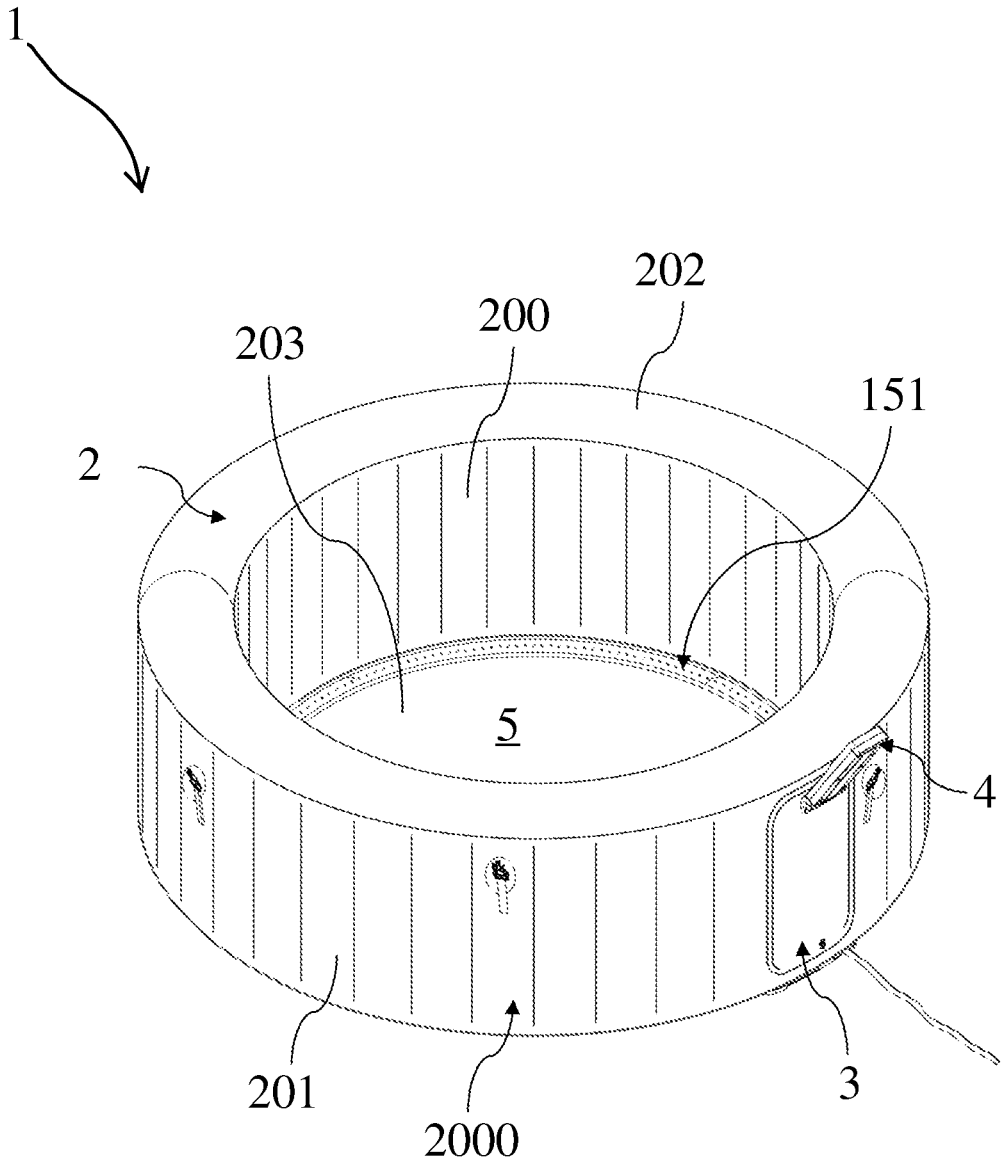
FIG. 1 is a schematic external view of an inflatable massage pool according to an example embodiment.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including", "comprise, and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

As used herein, the term "and/or" includes any and all combinations of one or more of the associated listed items. Expressions such as "at least one of," when preceding a list of elements, modify the entire list of elements and do not modify the individual elements of the list.

Various terms are used to refer to particular system components. Different companies may refer to a component by different names—this document does not intend to distinguish between components that differ in name but not function.

Matters of these example embodiments that are obvious to those of ordinary skill in the technical field to which these example embodiments pertain may not be described here in detail.

As used herein, expressions of the structural positions of components, e.g., upper, lower, top, bottom, etc., are not absolute but relative. When the components are arranged as shown in the figures, these directional expressions are appropriate, but when the positions of the components in the figures change, these directional expressions also change accordingly.

As used herein, the expression "inner" herein refers to a direction toward a water holding chamber or water placement zone or water receptacle defined by a pool wall and a pool bottom, and "outer" refers to a direction toward the exterior of the whole pool. The term "air" refers to air flow, etc., that can be introduced from an external atmosphere or by an apparatus, and "fluid" refers to liquid flow, such as water flow.

As used herein, the expression "a plurality of" means two or more, unless specifically defined otherwise.

As used herein, it should also be noted that the terms "arrange," "connected," and "connection" should be understood in a broad sense, unless otherwise explicitly specified and limited. For example, a connection can be a fixed connection, a detachable connection, or an integral connection; or can be a mechanical connection or an electrical connection; and can be directly connected, or indirectly connected by means of an intermediate medium, or communication between interiors of two elements. For those of ordinary skill in the art, the specific meaning of the terms used herein should be understood in specific cases.

It should be appreciated that related art massage pools have a control box disposed outside a pool body, and thus occupy a large space, are inconvenient for a user to store and use, and are inconvenient for the user to operate massage and other functions during use.

According to one or more example embodiments a control box is integrated with a pool body of a massage pool. The inflatable massage pool may have an integrally disposed control box in which a chamber is formed in a pool wall of a pool body to accommodate the control box, so that an overall occupied space may be reduced, and appearance may be improved, and convenient control and operation for a user may be provided.

Figure 2:
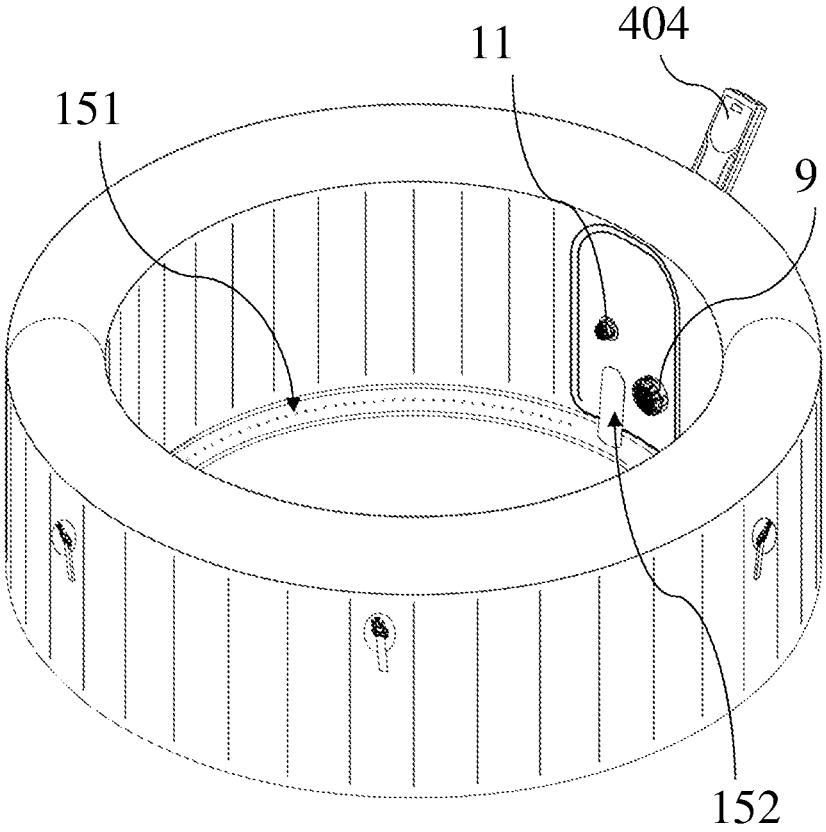
FIG. 2 is another schematic view of the inflatable massage pool of FIG. 1.

An example embodiment of an inflatable massage pool 1 is shown in conjunction with FIGS. 1 and 2. The inflatable massage pool 1 comprises a pool body 2, the pool body 2 comprising a water holding chamber or water placement zone or water receptacle 5 defined by a pool wall 2000 and a pool bottom 203. The pool wall 2000 is formed by a top wall 202, an outer wall 201, and an inner wall 200 which are disposed such that, in conjunction with the pool bottom 230, an air chamber (inflatable chamber) is defined therein. Although the pool wall 2000 shown in FIG. 1 is circular in shape when viewed from above, example embodiments are not limited to this, and may have any of a number of other shapes including, but not limited to a square, triangle, or ellipse. A plurality of tensioning members 6 (FIG. 3) may be provided in the air chamber to provide support and structural strength.

A top portion of the outer wall 201 and a top portion of the inner wall 200 are welded to the top wall 202, and a bottom portion of the outer wall 201 and a bottom portion of the inner wall 200 are welded to the pool bottom 203 to form the air chamber inside the pool wall 2000. The plurality of tensioning members 6 may be arranged at fixed or variable intervals within the air chamber of the pool wall 2000. The opposite sides of each tensioning member 6 are welded to the outer wall 201 and the inner wall 200, respectively. In the illustrated example of FIG. 3, each tensioning member 6 extends, widthwise, in a radial direction of the pool wall 2000.

The pool bottom 203 is provided with an air passage 151 to provide a massage function with bubbles. Additionally or alternatively, such an air passage may be provided in the inner wall 200 of the pool wall 2000. The control box 4 is arranged in an accommodating chamber or cavity 3 provided in the pool wall 2000. The accommodating cavity 3 is isolated from the air chamber in a sealed manner. The control box 4 may be configured to control at least a massage function of the inflatable massage pool 1. The control box 4 may be configured to circulate water in the water receptacle 5 and/or to supply air into the water receptacle 5, for example, by controlling fluid to enter or exit the water receptacle 5 and/or by controlling air to enter the air passage 151. The control box 4 may further be configured to inflate the pool by controlling air to enter the air chamber.

Figure 3:
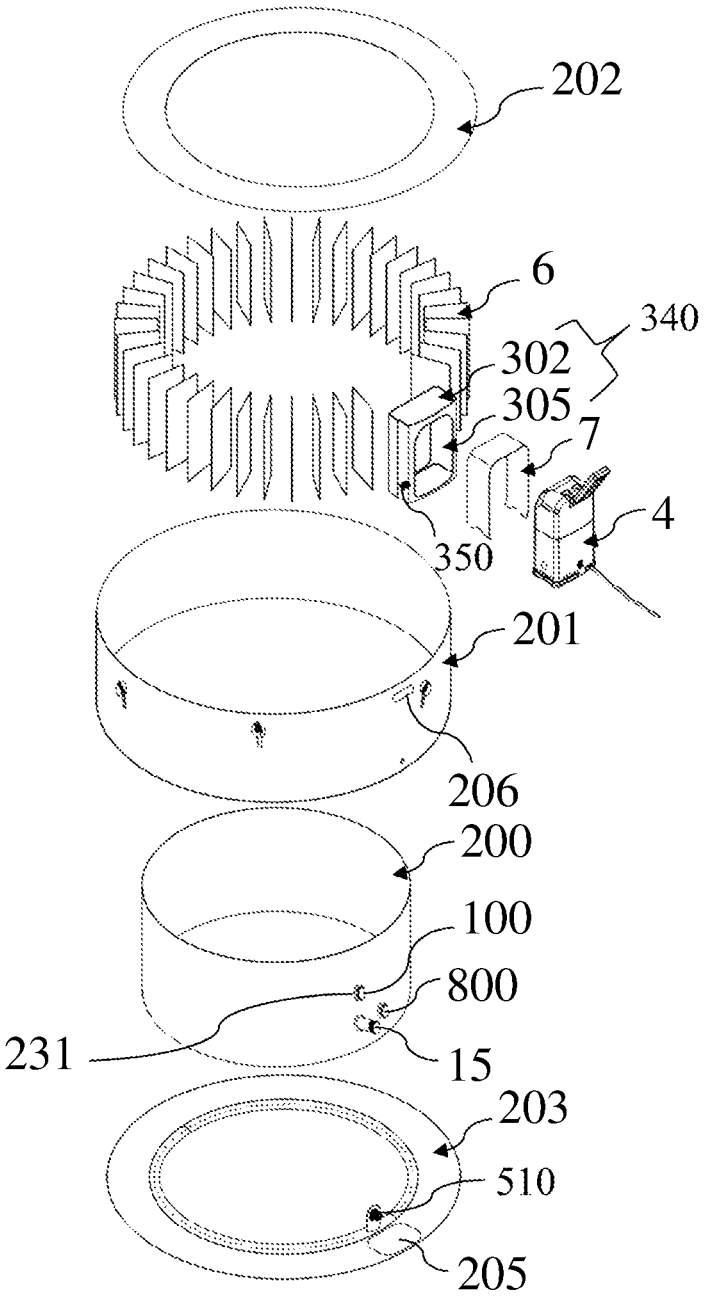
FIG. 3 is a schematic exploded view of the inflatable massage pool of FIG. 1.
Figure 4A:
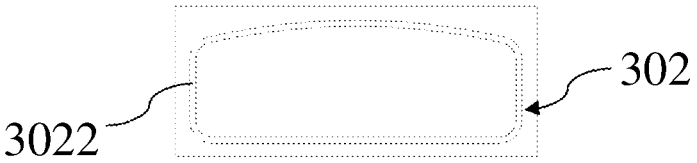
FIG. 4A is a schematic plan view of a sheet that forms a chamber upper wall.
Figure 4B:
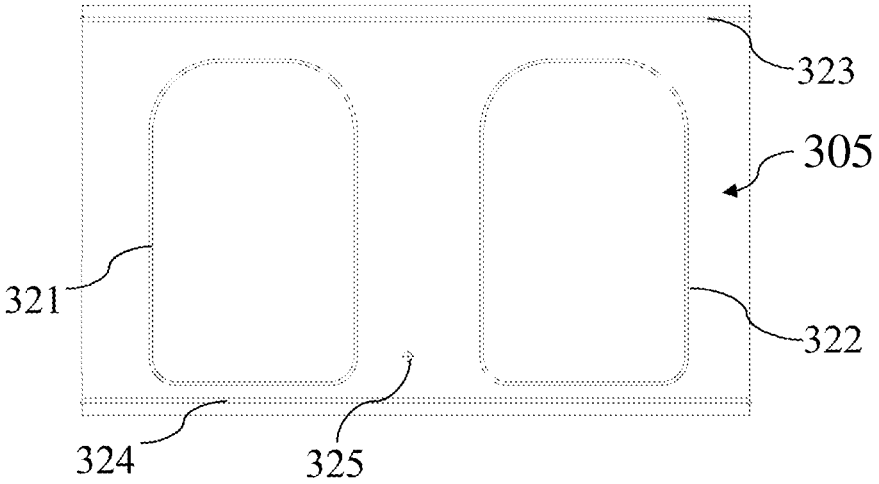
FIG. 4B is a schematic plan view of a sheet that forms a chamber surrounding wall.
Figure 4C:
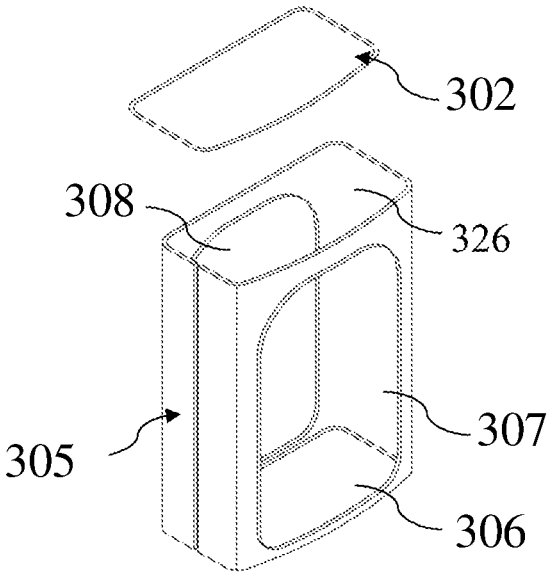
FIG. 4C is a schematic exploded view of a chamber upper wall and a chamber surrounding wall.

According to one or more example embodiments, the accommodating cavity 3 may be separated from the air chamber by a chamber wall or by an accommodating wall 340 (FIG. 3). The accommodating wall 340 separates the accommodating cavity 3 from the air chamber. The accommodating wall 340 may extend between the outer wall 201 and the inner wall 200 and be connected to both the outer wall 201 and the inner wall 200. The accommodating wall 340 may be made of a weldable material such as a polyvinyl chloride (PVC) material or a PVC composite material, and may be connected to the pool body by welding to form an integrated structure. As shown in FIGS. 3 to 4C, according to one or more example embodiments, the accommodating wall 340 comprises a chamber surrounding wall or side wall 305 shaped so as to surround the control box 4. The side wall 305 may be formed by a single sheet or by multiple sheets disposed in an enclosing manner. FIG. 4B shows the side wall 305 in a deployed state, for example, a sheet of a rectangular PVC material or a PVC composite material, with two short sides of the rectangular sheet being connected to each other in an enclosing manner to form the side wall 305. The side wall 305 may be connected to both the outer wall 201 and the inner wall 200 of the pool body 2000, respectively, along an outer wall welding line 321 and an inner wall welding line 322. In addition, a low portion of the side wall 305 may be provided with a bottom wall welding line 324 to be connected to the pool bottom 203 in a sealing manner so as to form a first hole or opening 306 through which the control box 4 can be put into the accommodating cavity 3. The pool bottom 203 may comprise a second hole or opening 205 as an access opening, corresponding to the first opening 306, as shown in FIG. 3. Additionally or alternatively, such an access opening may be arranged in the outer wall 201 so as to correspond to a front hole or opening 307 formed in the side wall 305.

According to one or more example embodiments, parts of the side wall 305 may be cut along the outer wall welding line 321 and the inner wall welding line 322 so as to form the third opening 307 and a fourth opening (back hole) 308 in the side wall 305. In this way, the side wall 305 may be connected to the outer wall 201 of the pool wall 2000 via the outer wall welding line 321 and to the inner wall 200 of the pool wall 2000 via the inner wall welding line 322.

According to one or more example embodiments, a top opening 326 of the side wall 305 may be connected to the top wall 202 of the pool body 2000 along the upper wall welding line 323 so as to close the opening 326. Alternatively, the accommodating wall 340 may include an upper wall 302 facing the top wall 202 of the pool wall 2000. More specifically, the opening 326 can be connected to the chamber upper wall (cavity upper wall) 302 along the upper wall welding line 323, and the chamber upper wall 302 may be made of a weldable material such as a PVC material or a PVC composite material and may be correspondingly provided with a side wall welding line 3022. In this way, the upper wall 302 and the side wall 305 together define the accommodating cavity 3, and the control box 4 is adapted to enter the accommodating cavity 3 through the second opening 205 in the pool bottom 203 of the pool body and is then integrated with the pool body. The upper wall 302 enables a height of the accommodating cavity 3 to be tailored to the height of the control box 4. This may be utilized when the pool wall 2000 has a height much higher than that of the control box 4, because the side wall 305 would not be required to extend to reach the top wall 202 of the pool wall 2000.

As can be seen from FIGS. 3 and 4B, the side wall 305 may include an air supply port 325. In this case, the control box 4 includes a first air supply end (inner inflation hole) 407 (FIG. 6) to be in communication with the air chamber of the pool body via the air supply port 325 and an air supply pipe 350 (FIG. 3) connected to the first air supply end 407.

Figure 6:
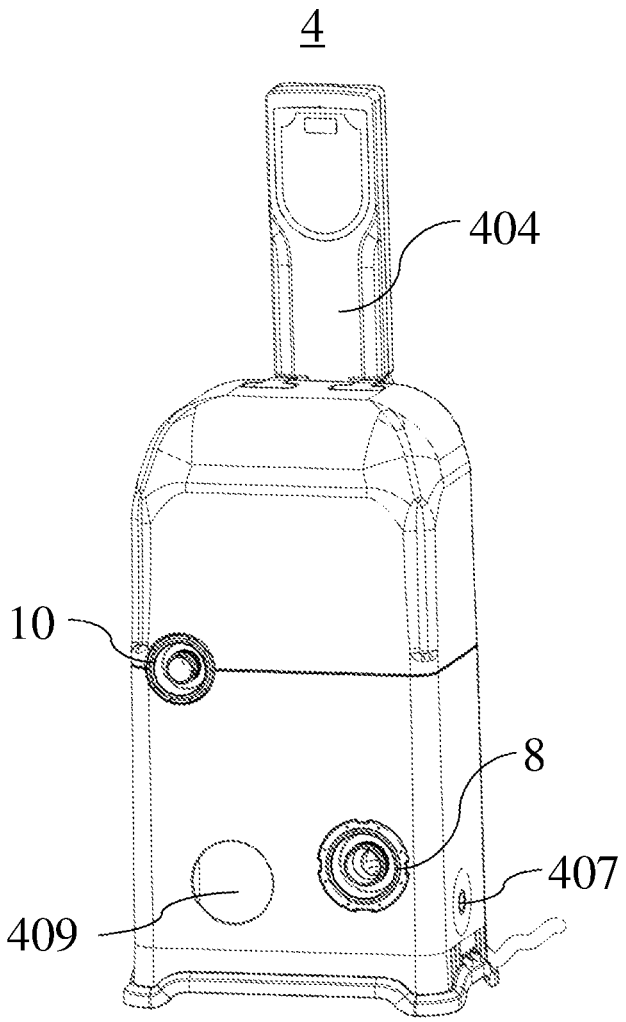
FIG. 6 is a schematic view of a control box.

According to one or more example embodiments, the control box 4 may include a control panel 404 (FIG. 6). The control panel 404 may be foldable with respect to the main body of the control box 4. The control panel 404 is configured so that users may operate at least some of the functions of the inflatable massage pool, such as water filling function or massage function, during use. The pool body may have an opening through which the control panel 404 extends out of the pool wall 2000. In the example embodiment of FIG. 3, the outer wall 201 is provided with a fifth opening (panel hole) 206, and the control panel 404 passes through the third opening 307 in the side wall 305 and the fifth opening 206 in the outer wall 201 and then extends out of the pool wall as shown in FIG. 1. The foldable control panel 404 may be foldable to align with the outer wall 201 of the pool wall 2000, particularly when not in use. Additionally or alternatively, such an opening through which the control panel 404 extends out may be provided in the chamber upper wall 302 and the top wall 202 depending on the location and shape of the control panel 404.

Figure 5A:
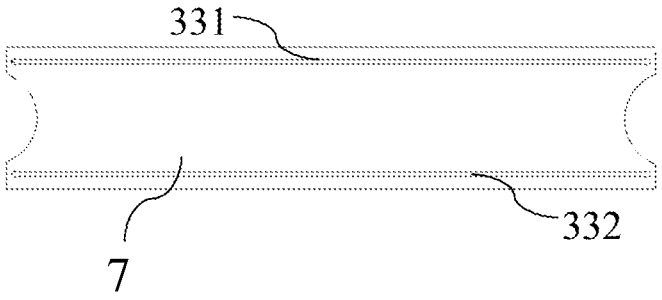
FIG. 5A is a schematic plan view of a sheet that forms a protective wall.
Figure 5B:
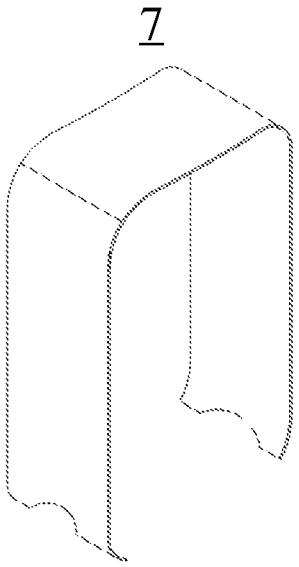
FIG. 5B is a schematic view of a protective wall.

According to one or more example embodiments, a protective wall 7 is arranged between the accommodating wall 340 and the control box 4. The protective wall 7 may match the contour of the accommodating wall 340 so as to prevent air leakage from the pool body caused by friction between the accommodating wall 340 and the control box 4. The protective wall 7 may be made of a weldable material such as PVC material or PVC composite material, and be connected to the pool body by welding so as to form an integrated structure. With reference to FIGS. 3, 5A and 5B, the protective wall 7 may be formed by a single sheet or strip and may be connected to both the outer wall 201 and the inner wall 200 of the pool body. FIG. 5A shows the protective wall 7 in a deployed state. The protective wall 7 may be connected to the inner wall 200 and the outer wall 201 along its side edges with an inner welding line 331 and an outer welding line 332. FIG. 5B shows the shape of the protective wall 7 when welded to the pool body.

It should be understood that the size and shape of the accommodating cavity defined by the accommodating wall 340, the size and shape of the protective wall 7, examples of which are illustrated in the figures to match an outer contour of the control box 4, and the size and shape of the control box, are not limited and may be determined according to design.

As shown in FIGS. 2, 3 and 6, the inner wall 200 of the pool body is provided with one or more openings or holes through which a pipeline passes. FIG. 3 shows an example of three openings, one of which is marked with 231. A water inlet assembly (pool water inlet connector) 11 is connected to a water inlet end (control box water inlet connector) 10 of the control box 4 through an opening in the inner wall. Through the water inlet assembly 11 and the water inlet end 10, water may be supplied from the control box 4 into the water receptacle 5. A water outlet assembly (pool water outlet connector) 9 is connected to a water outlet end (control box water outlet connector) 8 of the control box 4 through another opening in the inner wall. Through the water outlet assembly 9 and the water outlet end 8, water in the water receptacle may be discharged. The inner wall 200 is tightly clamped between the water inlet assembly 11 and the water inlet end 10, and/or between the water outlet assembly 9 and the water outlet end 8 of the control box 4 so as to achieve sealing. In order to enhance the sealing effect, a sealing member can be provided on the water inlet assembly 11 and/or on the water inlet end 10 of the control box 4, and a sealing member may be provided on the water output assembly 9 and/or the water outlet end 8 of the control box 4.

According to one or more example embodiments, intermediate members may be fixedly welded at the opening of the inner wall 200. In conjunction with the example embodiment shown in FIG. 6, the water inlet assembly 11 and the water outlet assembly 9 are connected to the water inlet end 10 and the water outlet end 8 of the control box 4, respectively, by means of a water inlet intermediate member (axial sealing assembly) 100 and a water outlet intermediate member (axial sealing assembly) 800, so as to enable filling and drainage of the water receptacle. The control box 4 further comprises a first air supply end (inner inflation hole) 407 in communication with the air chamber (inflation chamber) for inflating the air chamber, and a second air supply end (air inlet hole) 409 in communication with the air passage 151. The second air supply end 409 is in communication with the air passage 151 via an air inlet bag (connection channel) 152 and a corresponding air inlet assembly 510 (FIG. 3) and via another opening on the inner wall 200 and a corresponding air delivery pipe (pool air inlet connector) 15, such that the air may be sprayed from through holes in the air passage to form wave-making bubbles, providing a massage effect to the user's soles.

It should be understood that, in the illustrated example embodiments, the control box 4 integrates the functions of inflation, air supply, and water filling and drainage. According to one or more alternate example embodiments, these functions can be achieved by different control pumps, that is, if the spatial and structural layout allows, more than one control pump can be arranged in the accommodating cavity to respectively achieve one or more of the functions described above or other functions such as heating. According to one or more example embodiments, more than one accommodating chamber may be provided to respectively hold control pumps that achieve different functions.

In the illustrated example embodiments, the air passage 151 is shown in the shape of a circular ring in plan view. However, the air passage 151 is not limited thereto, and the air passage may be in the shape of a closed ring, an open ring, a four-sided ring or any other polygonal ring, or any other suitable form for providing users with a relaxing massage in the pool. Similarly, the inflatable massage pool is shown in a circular shape, but other shapes such as, but not limited to, a rectangular shape or other polygonal shapes are not excluded.

One or more of the pool body, the air passage and the air inlet bag may be made of a weldable material such as a PVC material or a PVC composite material The pool wall can be connected to the pool bottom by means of hot-melt welding, etc. to form the pool body, and the air passage can be formed at the pool bottom, for example, near or at the corner between the pool bottom 203 and the inner wall 200.

Figure 7:
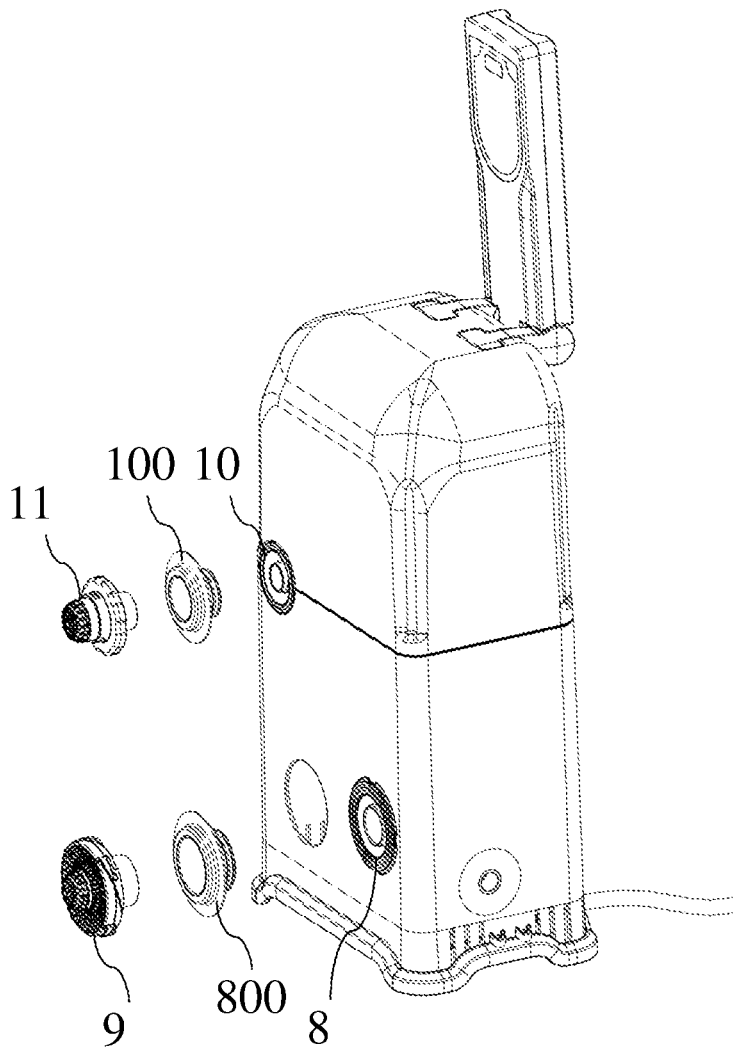
FIG. 7 is a schematic exploded view of fittings of a water intake end and a water output end of a control box.
Figure 8:
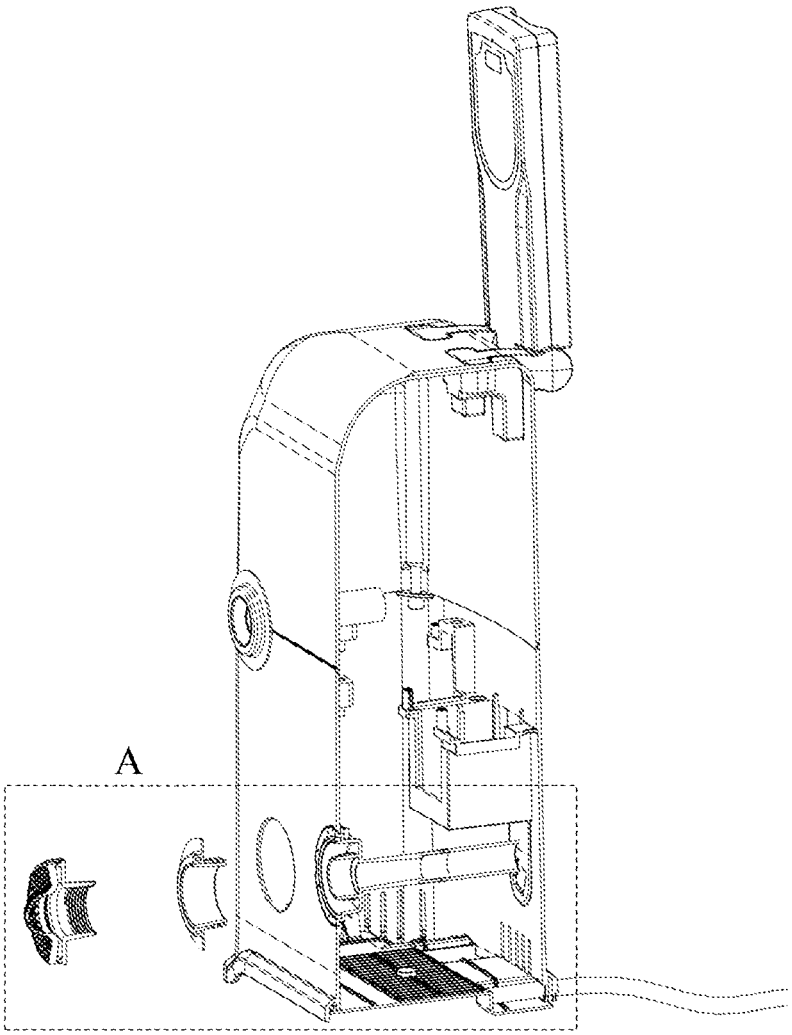
FIG. 8 is a schematic cross-sectional view of a control box, and shows a schematic exploded view of a fitting of a water intake end.
Figure 9:
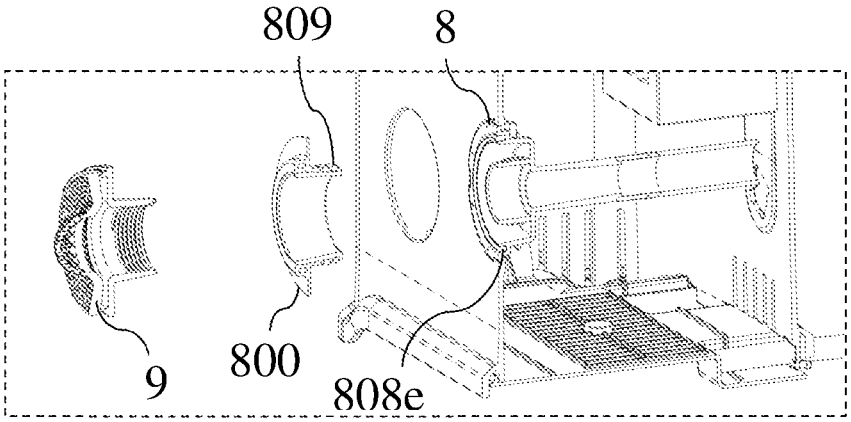
FIG. 9 is a schematic enlarged view of part A of FIG. 8.

FIGS. 7 to 9 show the fittings of the water outlet end (water outlet connection) and the water inlet end (water inlet connection) of the control box 4, according to an example embodiment. As described above, the water inlet assembly (pool water inlet connector) 11 and the water outlet assembly (pool water outlet connector) 9 are connected to the water inlet end 10 and the water outlet end 8 of the control box 4, respectively, by means of the water inlet intermediate member (axial sealing assembly) 100 and the water outlet intermediate member (first axial sealing assembly) 800. The water inlet intermediate member 100 and the water outlet intermediate member 800 may be welded or otherwise adhered to the inner wall 200 of the pool body. The water inlet assembly 11 and the water outlet assembly 9 may be welded or otherwise adhered to the water inlet end 10 and the water outlet end 8 of the control box 4, respectively, with the water inlet intermediate member 100 and the water outlet intermediate member 800 being interposed therebetween. Alternatively, the water inlet assembly 11 may be detachably attached to the water inlet end 10, and/or the water outlet assembly 9 may be detachably attached to the water outlet end 8. FIG. 9 illustrates an example in which the water outlet assembly 9 is removed from the water outlet end 8, and the water outlet intermediate member 800 may include a sealing ring 809 to prevent water leakage at the connection. The water outlet end 8 may also be provided with a sealing ring 808*e* to further prevent water leakage.

According to one or more example embodiments, the control box is disposed in the pool body to form an integrated structure, so that the product may be aesthetically pleasing in overall appearance, may occupy a comparatively small space, and may be convenient for the user to operate. The control box may be separated from the air chamber of the pool body in a sealing manner, achieving safe and reliable use.

It should be understood that the example embodiments illustrated in the figures illustrate various shapes, sizes and arrangements of components of the inflatable massage pool, which are merely illustrative but not restrictive, and other shapes, sizes and arrangements may be used in conjunction with any of the example embodiments described herein. The components and features described herein may be made of any of a variety of materials including, but not limited to, polymers exemplified above and other suitable materials, such as, but not limited to rubber, foam, metal and coated fabric, or combinations thereof well known to those skilled in the art.

It should be understood that above-described example embodiments are illustrative but not restrictive.

Other Example Embodiments

With reference to FIGS. 10-37, other example embodiments are described. For the sake of completeness in disclosure, some features already discussed above may again be described.

Figure 10:
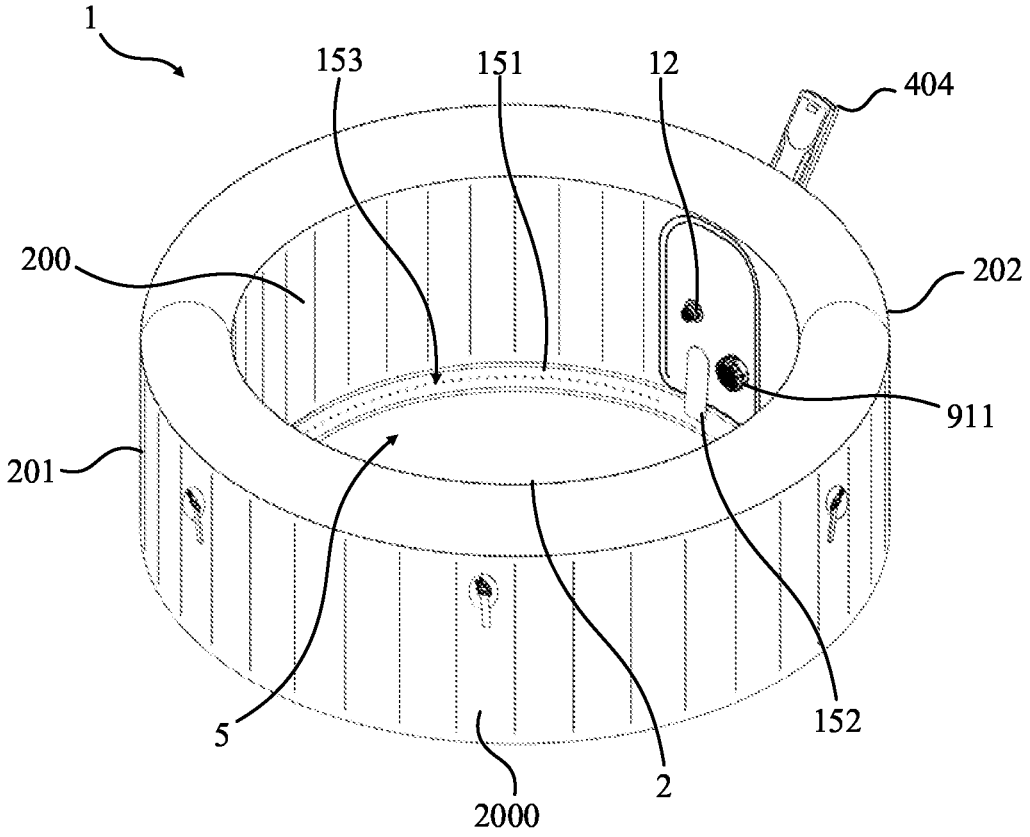
FIG. 10 shows a perspective view of an inflatable massage pool according to an example embodiment.
Figure 11:
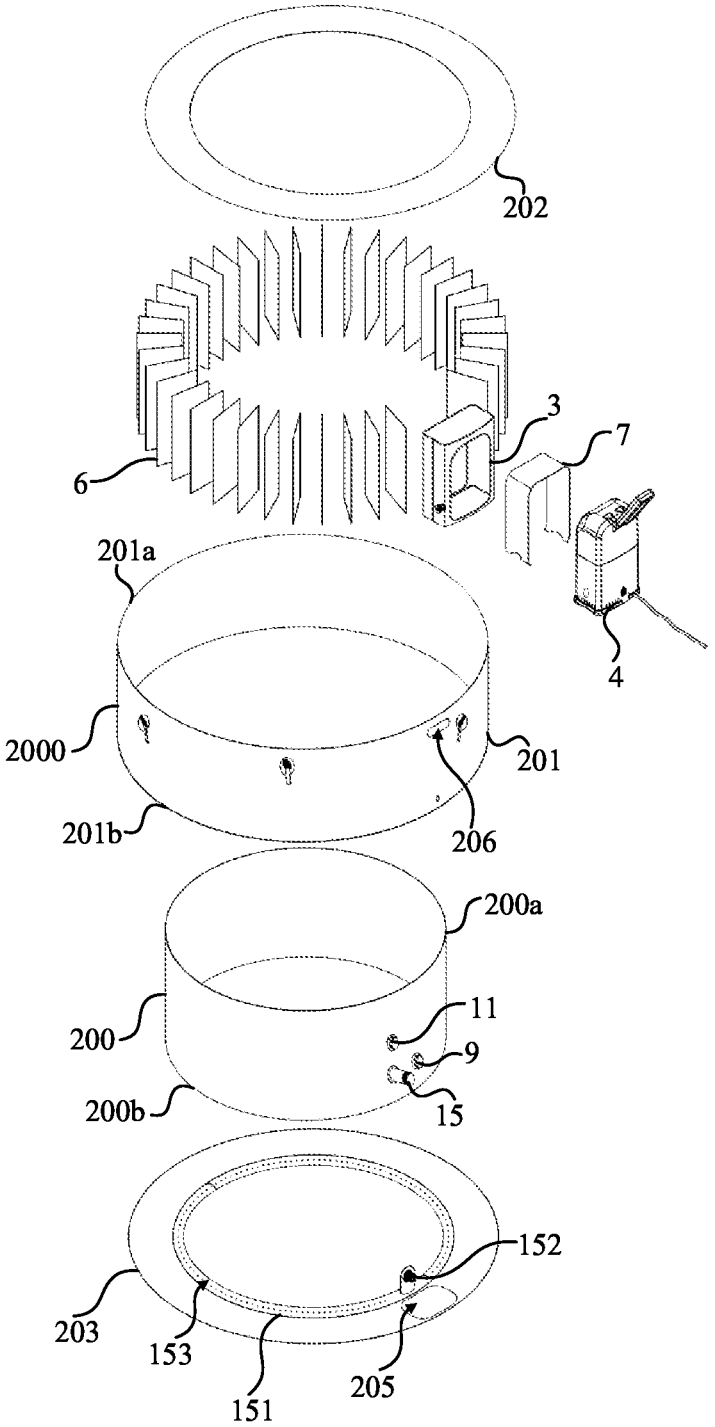
FIG. 11 shows an exploded view of an inflatable massage pool according to an example embodiment.

With reference to FIGS. 10 and 11, according to an example embodiment, an inflatable massage pool 1 is provided. The inflatable massage pool 1 includes: a pool body 2, a control box accommodating cavity (accommodating chamber) 3, and a control box 4, where the pool body 2 includes a pool wall 2000, and the pool wall 2000 defines an inflatable chamber (air chamber). For example, the pool wall 2000 includes an inner wall 200, an outer wall 201, a top wall 202 and a pool wall 203 (or a part of the pool bottom 203). The inner wall 200, the outer wall 201, the top wall 202 and the pool bottom 203 (or a part of the pool bottom 203) define the inflatable chamber described above. Optionally, the inflatable chamber may be formed by welding an upper end 200*a* of the inner wall 200 to the top wall 202 and welding a lower end 200*b* of the inner wall 200 to at least a part of the pool bottom 203; and by welding an upper end 201*a* of the outer wall 201 to the top wall 202 and welding a lower end 201*b* of the outer wall 201 to the pool bottom 203. For example, the inner wall 200, the outer wall 201, the top wall 202 and the pool bottom 203 may be partially or completely made of a weldable material. For example, the weldable material may include, but is not limited to, thermoplastic urethane (TPU) or PVC.

The pool wall 2000 and the pool bottom 203 define a water placement zone (water receptacle) 5.

The control box accommodating cavity 3 is provided in the pool wall 2000 and isolated from the inflatable chamber in a sealed manner. The control box 4 is located in the control box accommodating cavity 3. The control box 4 is configured to supply air and/or water to the pool body 2. For example, the control box 4 may be in fluid communication with the water placement zone 5 of the pool body 2. The control box 4 may be configured to control various functions of the inflatable massage pool 1.

For example, the inflatable chamber is further internally provided with one or more tensioning members 6. The tensioning members 6 are connected to the inner wall 200 and the outer wall 201 of the pool body 2. After being tensioned, a tensioning member 6 provides a pulling force so as to limit deformation of a wall of the inflatable chamber, such that the inflatable chamber may keep a certain shape after being inflated.

The control box 4 is placed in the control box accommodating cavity 3, where the control box accommodating cavity 3 is located in the pool wall 2000. For example, the control box accommodating cavity 3 may be located in a space formed by the inner wall 200, the outer wall 201, the top wall 202 and the pool bottom 203 of the pool body 2. In this way, the control box 4 is integrated into the pool body 2, such that no extra space for placing the control box 4 is required outside the pool body 2, and an appearance of the entire inflatable massage pool 1 may be clean.

An example structure of the control box accommodating cavity will be described in detail below in conjunction with the accompanying drawings.

Figure 12:
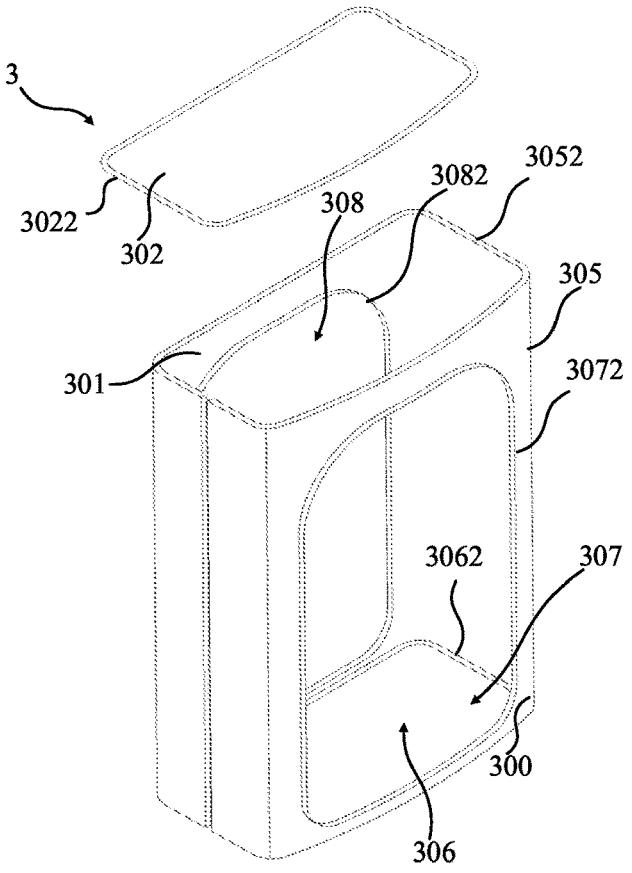
FIG. 12 shows an exploded view of a control box accommodating cavity.

With reference to FIGS. 10-12, the control box accommodating cavity 3 includes a side wall 305 and an upper wall 302.

For example, the control box accommodating cavity 3 may have a substantially cuboid shape. The side wall 305 is formed by enclosing a weldable material sheet. The side wall 305 is provided with a front hole or opening 307 and a back hole or opening 308. A front hole periphery 3072 on a front side 300 of the side wall 305 and the outer wall 201 of the pool body 2 are welded to form a sealed connection, and a back hole periphery 3082 on a back side 301 of the side wall 305 and the inner wall 200 of the pool body 2 are welded to form a sealed connection. A periphery 3022 of the upper wall 302 is welded to an upper end of the side wall 305. A lower edge 3062 of the side wall 305 and the pool bottom 203 are welded to form a sealed connection, and the lower edge 3062 of the side wall 305 is provided with a first hole or opening 306, such that the first hole 306 is located at a bottom of the control box accommodating cavity 3. Corresponding to a position of the first hole 306, the pool bottom 203 is provided with a second hole or opening 205 as an access opening, and the first hole 306 is in communication with the second hole 205, so as to allow the control box 4 to enter the control box accommodating cavity 3 from the pool bottom 203. In this way, the control box accommodating cavity 3 isolates outside air from the inflatable chamber and may accommodate the control box 4, so as to facilitate mounting the control box 4 in the pool wall 2000 or removing the control box 4 from the pool wall 2000. Meanwhile, the control box accommodating cavity 3 is welded and fixed to the pool wall 2000, such that the control box accommodating cavity 3 may also limit a position of the control box 4 in the pool wall 2000, and the control box 4 may be limited from moving freely in the inflatable chamber and possibly components including a water supply pipeline.

It may be understood that in other example embodiments, the first hole 306 and the second hole 205 may also be provided on the pool wall 2000, and accordingly, the control box 4 may enter the control box accommodating cavity from the first hole 306 and the second hole 205 provided on the pool wall 2000.

For example, the first hole 306 and the second hole 205 may both have a rounded rectangle shape.

The second hole 205 may be used as an air inlet, so as to allow an air pump of the control box 4 to suck the outside air from the air inlet, and then supply air to a wave making channel described below and provide a bubble massage function. In other words, when the air pump in the control box 4 is functioning, the outside air may be sucked into the control box 4 via the second hole 205 and the first hole 306, pressurized by the air pump, and conveyed into water in the water placement zone 5 via the pipeline, so as to form bubbles having a massage function.

Figure 13:
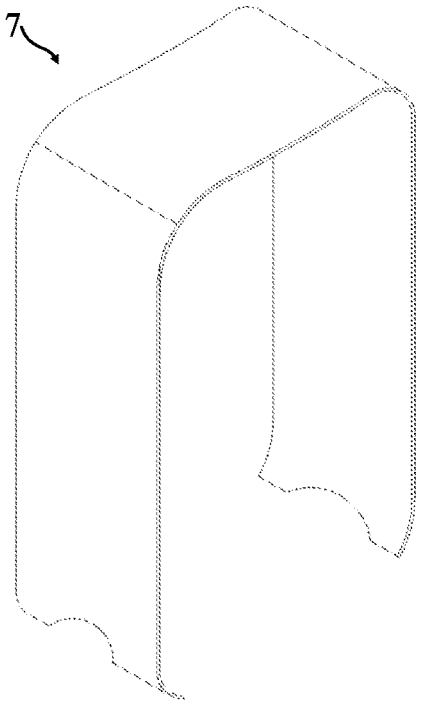
FIG. 13 shows a perspective view of a protective wall.

With reference to FIGS. 11 and 13, at least one protective wall 7 may be arranged between the control box accommodating cavity 3 and the control box 4. The protective wall 7 is located between the control box accommodating cavity 3 and the control box 4, and is configured to prevent the control box 4 from making direct contact with the control box accommodating cavity 3 and causing friction with the control box accommodating cavity 3 and then causing air leakage of the inflatable chamber.

Figure 14:
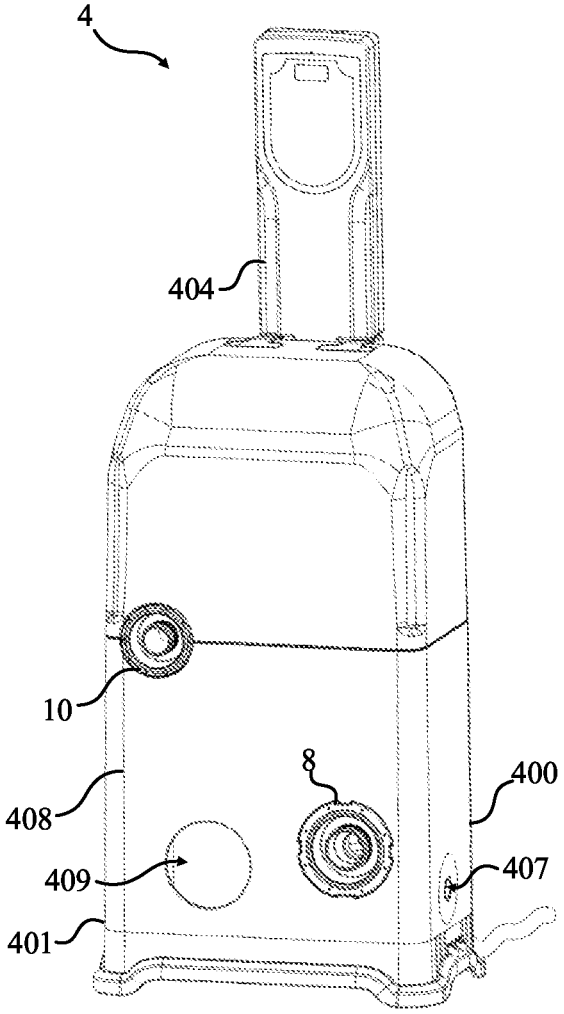
FIG. 14 shows a perspective view of a control box.

With reference to FIGS. 11, 12 and 14, the outer wall 201 of the pool body is provided with a panel hole 206. The panel hole 206 is aligned with the front hole 307, so as to allow a control panel 404 of the control box 4 to extend out of the outer wall 201 of the pool body. For example, the control panel 404 may allow a user to set a working state of the control box 4.

Figure 15:
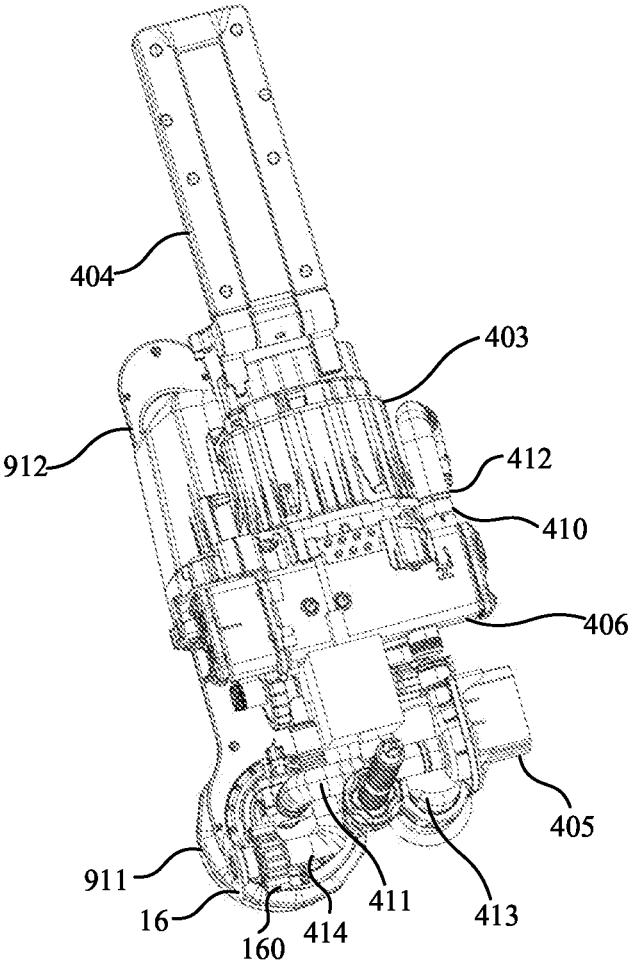
FIG. 15 shows a perspective view of a control box, in which a housing of the control box is hidden.

With reference to FIGS. 11, 14 and 15, the control box 4 is internally provided with a fluid pipe 410, a water pump 405, an air pump 403, and a heater 406, where the fluid pipe 410 includes a water outlet pipe 411, a water inlet pipe 412, an air inlet pipe 413, and an inflation pipe 414. A front end surface 408 of the control box 4 is provided with a control box water outlet connector 8. The inner wall 200 of the pool body is provided with a pool water outlet connector 9. One end of the control box water outlet connector 8 is in communication with the water outlet pipe 411, and the other end of the control box water outlet connector is in communication with the pool water outlet connector 9. In this way, the water in the water placement zone of the pool body may traverse the pool water outlet connector 9 and the control box water outlet connector 8 successively, and thus enter the water outlet pipe 411 in the control box.

The front end surface 408 of the control box 4 is provided with a control box water inlet connector 10. The inner wall 200 of the pool body is provided with a pool water inlet connector 11. One end of the control box water inlet connector 10 is in communication with the water inlet pipe 412, and the other end of the control box water inlet connector is in communication with the pool water inlet connector 11. In this way, water in the water inlet pipe 412 of the control box 4 may traverse the control box water inlet connector 10 and the pool water inlet connector 11 successively, and thus enter the water placement zone of the pool body, where the water outlet pipe 411 is in communication with the water inlet pipe 412. Specifically, water may enter the water outlet pipe 411 from the water placement zone 5 of the pool body, pass the water pump 405, flow through the heater 406, then enter the water inlet pipe 412, and finally return to the water placement zone 5. That is, the water pump 405 is in fluid communication with the water placement zone of the pool body, so as to enable water circulation. On one hand, the heater 406 may heat the water as desired, so as to make a user in the water placement zone 5 more comfortable. On the other hand, a filtering apparatus arranged on a water circulation path may filter impurities in the water. For example, a filtering apparatus 911 is mounted on the inner wall 200 of the pool body 2 as shown in FIG. 10.

A connection between the control box water outlet connector 8 and the pool water outlet connector 9 will be described in detail below in conjunction with the accompanying drawings.

Figure 16:
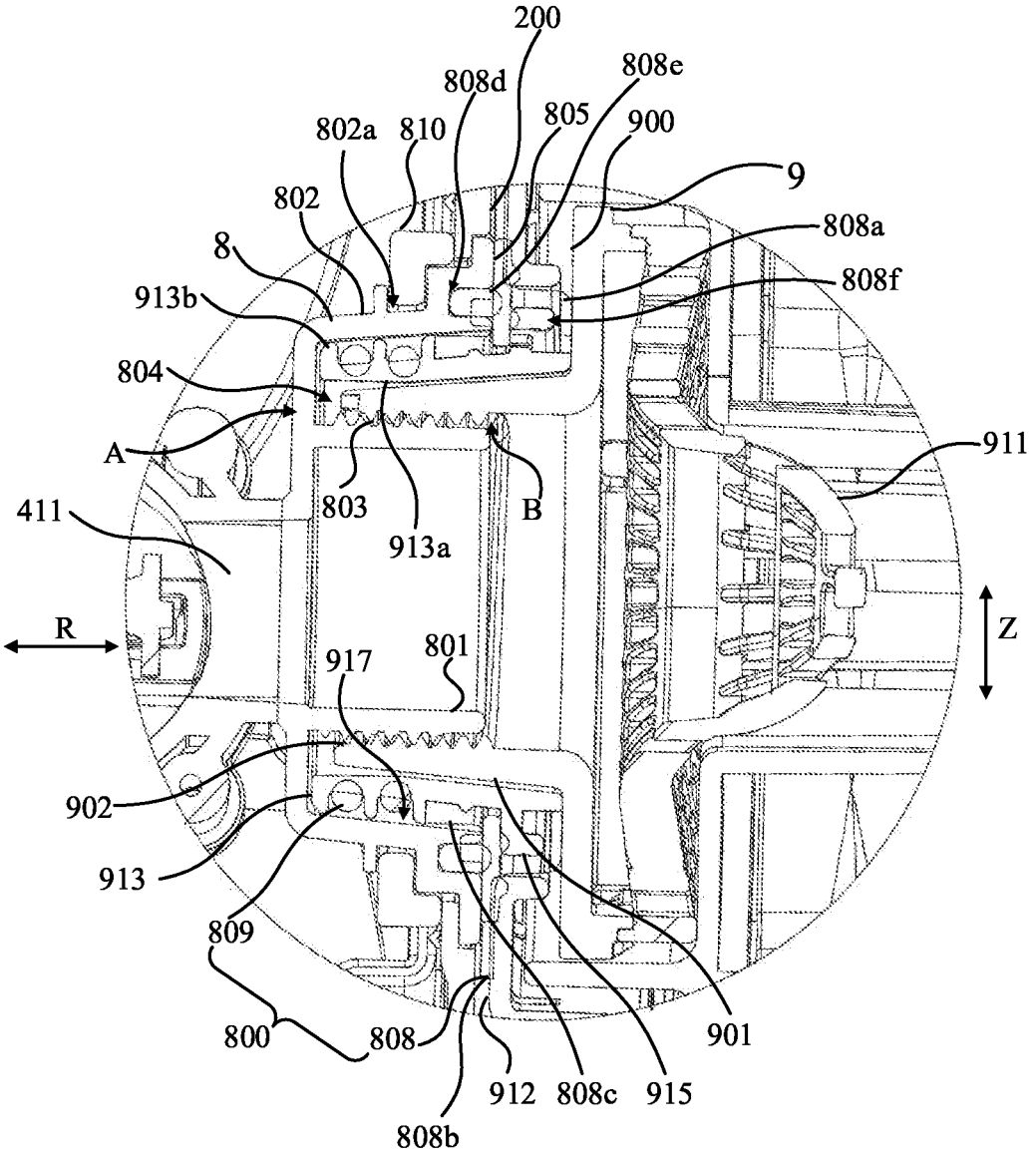
FIG. 16 shows a cross-sectional view of a connection between a control box water outlet connector and a pool water outlet connector.

With reference to FIGS. 11, 12 and 16, according to an example embodiment, the inflatable massage pool further includes a water outlet sealing assembly 800, the control box 4 includes the control box water outlet connector 8, the inner wall 200 of the pool body is provided with the pool water outlet connector 9, and the back side 301 of the control box accommodating cavity 3 is provided with the back hole 308, so as to allow the pool water outlet connector 9 to penetrate the back hole 308 to be connected to the control box water outlet connector 8 in a sealed manner by means of the water outlet sealing assembly 800, where the water outlet sealing assembly 800 may simultaneously achieve a sealed connection between the control box water outlet connector 8 and the pool water outlet connector 9 in a radial direction (a Z direction in FIG. 16) and an axial direction (an R direction in FIG. 16) of the control box water outlet connector 8. The control box water outlet connector 8 is connected to the pool water outlet connector 9 in a sealed manner, such that water may be prevented from leaking when entering the control box water outlet connector 8 from the pool water outlet connector 9.

Figure 17:
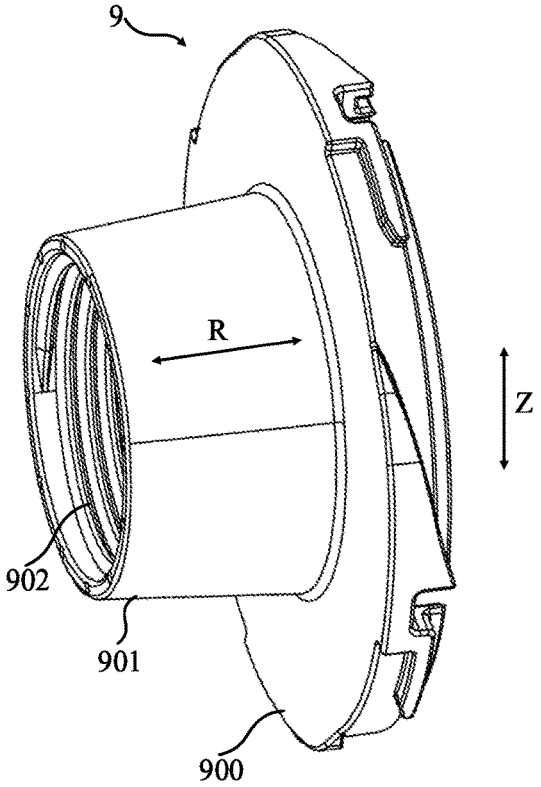
FIG. 17 shows a perspective view of a pool water outlet connector.

Specifically, the water outlet sealing assembly 800 includes a first radial sealing member 809. For example, the first radial sealing member 809 may be an annular sealing ring. With reference to FIGS. 16 and 17, the pool water outlet connector 9 includes a water outlet insertion end 901. For example, the water outlet insertion end 901 may be a hollow tubular structure. A radial size of the water outlet insertion end 901 of the pool water outlet connector 9 gradually increases in an axial direction, toward an interior of the control box.

The sealing member described herein and hereafter may be made of an elastic material. The elastic material may be, but is not limited to, rubber or silica gel.

Figure 18:
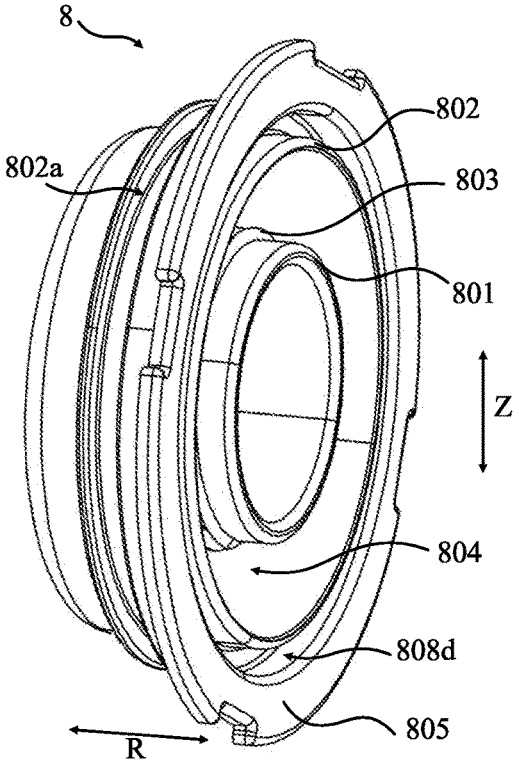
FIG. 18 shows a perspective view of a control box water outlet connector.

With reference to FIGS. 16 and 18, the control box water outlet connector 8 includes a water outlet slot 804. For example, one end of the water outlet slot 804 facing away from the filter 911 may be closed, as shown at A in FIG. 16, and the other end of the water outlet slot may be open, as shown at B in FIG. 16.

The water outlet insertion end 901 is inserted into the water outlet slot 804. The first radial sealing member 809 is arranged between the water outlet insertion end 901 and a slot wall of the water outlet slot 804, and abuts against a side wall of the water outlet insertion end 901 and the slot wall of the water outlet slot 804 separately, such that the water outlet insertion end 901 is connected to the water outlet slot 804 in a sealed manner.

The control box water outlet connector 8 includes an inner control box water outlet connector 801 and an outer control box water outlet connector 802. The outer control box water outlet connector 802 is arranged around the inner control box water outlet connector 801 so as to define the water outlet slot 804. For example, a radial size of the outer control box water outlet connector 802 is greater than that of the inner control box water outlet connector 801. That is, a distance between the outer control box water outlet connector 802 and the inner control box water outlet connector 801, in a radial direction, forms the water outlet slot 804, and the water outlet insertion end 901 is inserted into the water outlet slot 804.

The inner control box water outlet connector 801 is connected to the water outlet insertion end 901 in a sealed manner. Optionally, the inner control box water outlet connector 801 may be hollow and may be provided with an outer thread 803 on an outer surface, and the water outlet insertion end 901 may be provided with an inner thread 902 on an inner wall. The outer thread 803 is connected to the inner thread 902. The first radial sealing member 809 is located between an outer wall of the water outlet insertion end 901 and the slot wall of the water outlet slot 804, such that the water outlet slot 804 is connected to the water outlet insertion end 901 in a sealed manner. It may be understood that the inner control box water outlet connector 801 and the water outlet insertion end 901 may further be connected to each other in any of a number of known ways such as, but not limited to, a flange connection or an interference fit connection.

Figure 19:
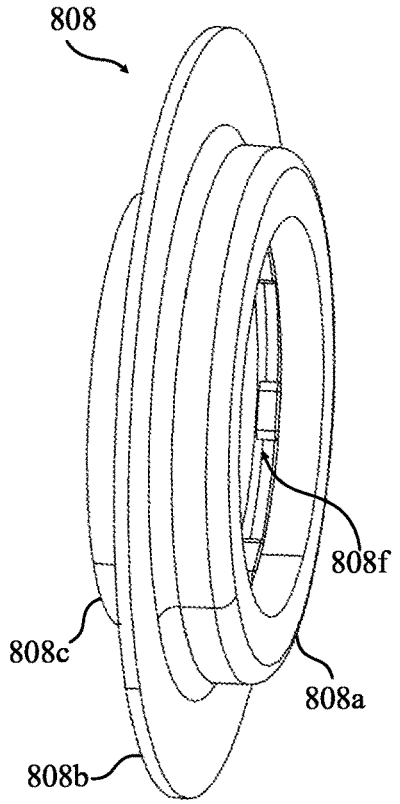
FIG. 19 shows a perspective view of a first axial sealing member.

With reference to FIGS. 16 and 19, the water outlet sealing assembly 800 further includes a first axial sealing member 808; the pool water outlet connector 9 further includes a first water outlet end surface 900 connected to the water outlet insertion end 901; and the first water outlet end surface 900 extends outward in the radial direction (the Z direction in FIG. 16) of the pool water outlet connector 9.

The control box water outlet connector 8 further includes a second water outlet end surface 805 connected to the water outlet slot 804; and the second water outlet end surface 805 extends outward in the radial direction of the control box water outlet connector 8. For example, the second water outlet end surface 805 may be annular.

The first water outlet end surface 900 and the second water outlet end surface 805 are arranged opposite each other and are spaced from each other at an interval in the axial direction of the control box water outlet connector 8 (the R direction in FIG. 16). The first axial sealing member 808 is located between the first water outlet end surface 900 and the second water outlet end surface 805, and is connected in a sealed manner to the first water outlet end surface 900 and the second water outlet end surface 805, separately, in the axial direction of the control box water outlet connector 8. For example, the first axial sealing member 808 is connected to the first water outlet end surface 900 and the second water outlet end surface 805 separately in a sealed manner, such that water leaking into the water outlet slot 804 may be effectively prevented from leaking between the first water outlet end surface 900 and the second water outlet end surface 805.

Figure 20:
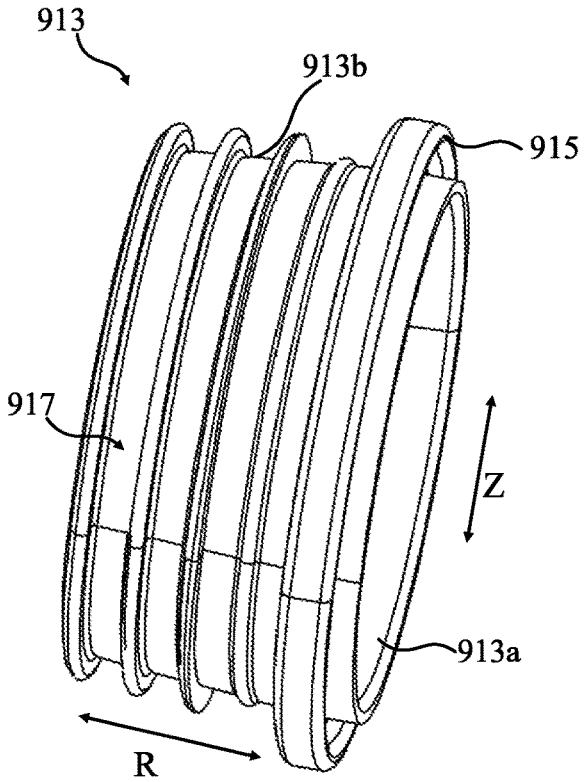
FIG. 20 shows a perspective view of a water outlet fixing member.

With reference to FIGS. 16 and 20, the inflatable massage pool further includes a water outlet fixing member 913; at least a part of the water outlet fixing member 913 is located in the water outlet slot 804; an inner wall 913*a* of the water outlet fixing member 913 abuts against the outer wall of the water outlet insertion end 901; and an outer wall 913*b* of the water outlet fixing member 913 abuts against the slot wall of the water outlet slot 804. The water outlet insertion end 901 and the water outlet fixing member 913 jointly achieve sealing between the control box water outlet connector 8 and the pool water outlet connector 9. An outer diameter of the water outlet insertion end 901 gradually decreases in a direction away from the first water outlet end surface 900, such that the water outlet fixing member 913 is gradually pressed as the water outlet insertion end 901 is fastened to the inner control box water outlet connector 801.

The outer wall 913*b* of the water outlet fixing member 913 is provided with a water outlet sealing clamping groove 917, and the water outlet sealing clamping groove 917 accommodates the first radial sealing member 809. The first radial sealing member 809 is pressed between the water outlet fixing member 913 and the inner wall of the outer control box water outlet connector 802, so as to form a seal between the control box water outlet connector 8 and the pool water outlet connector 9. There are two or more water outlet sealing clamping grooves 917, and each of the water outlet sealing clamping grooves 917 accommodates one first radial sealing member 809, such that sealing may still be ensured when any first radial sealing member 809 fails.

With reference to FIGS. 16 and 19, the first axial sealing member 808 includes a first protrusion 808*a*, and an inner wall of the first protrusion 808*a* is provided with a first clamping groove 808*f*. The outer wall 913*b* of the water outlet fixing member 913 is provided with a clamping part 915 in a protruding manner. The clamping part 915 is connected to the first clamping groove 808*f* in a clamped manner. For example, the first protrusion 808*a* covers the clamping part 915, such that a certain tightness is ensured and relative fixation of the first axial sealing member 808 and the water outlet fixing member 913 is achieved.

With reference to FIGS. 16 and 19, the first axial sealing member 808 further includes a connection part 808*b* and a second protrusion 808*c*. The first protrusion 808*a* and the second protrusion 808*c* are located at opposite ends of the connection part 808*b* in the axial direction of the first axial sealing member 808 (the R direction in FIG. 16), respectively. For example, a radial size of the first protrusion 808*a* is greater than that of the second protrusion 808*c*. The second protrusion 808*c* is clamped between the outer wall 913*b* of the water outlet fixing member and the slot wall of the water outlet slot 804 in the radial direction of the first axial sealing member 808 (the Z direction in FIG. 16). The connection part 808*b* extends outward in the radial direction of the first axial sealing member 808 so as to be attached to the inner wall 200 of the pool body. A surface of the connection part 808*b* and the inner wall 200 of the pool body are welded and sealed to prevent water from leaking from a joint between the second water outlet end surface 805 and the connection part 808*b*.

With reference to FIGS. 16 and 18, one side of the second water outlet end surface 805 facing the connection part 808*b* is provided with a second clamping groove 808*d* extending in the axial direction of the control box water outlet connector 8; the second clamping groove 808*d* accommodates a first water outlet sealing ring 808*e*; and the first water outlet sealing ring 808*e* abuts against the connection part 808*b*. For example, the first axial sealing member 808 and the first water outlet sealing ring 808*e* fill a space between the first water outlet end surface 900 and the second water outlet end surface 805 in the axial direction of the control box water outlet connector 8 (the R direction in FIG. 16), and the first water outlet end surface 900 and the second water outlet end surface 805 also press the first axial sealing member 808 and the first water outlet sealing ring 808*e*, such that a gap between the first water outlet end surface 900 and the second water outlet end surface 805 is as small as possible, so as to achieve a better sealing effect.

An outer wall of the outer control box water outlet connector 802 is provided with a third clamping groove 802*a* configured to accommodate a fastening member 810, and the fastening member 810 is configured to fasten the control box water outlet connector 8 and the pool water outlet connector 9. For example, the fastening member 810 presses the water outlet insertion end 901 in the water outlet slot 804 of the control box water outlet connector 8 and the first radial sealing member 809 by means of a fastening force, such that sealing of the control box water outlet connector 8 and the pool water outlet connector 9 is made tighter.

Figure 21:
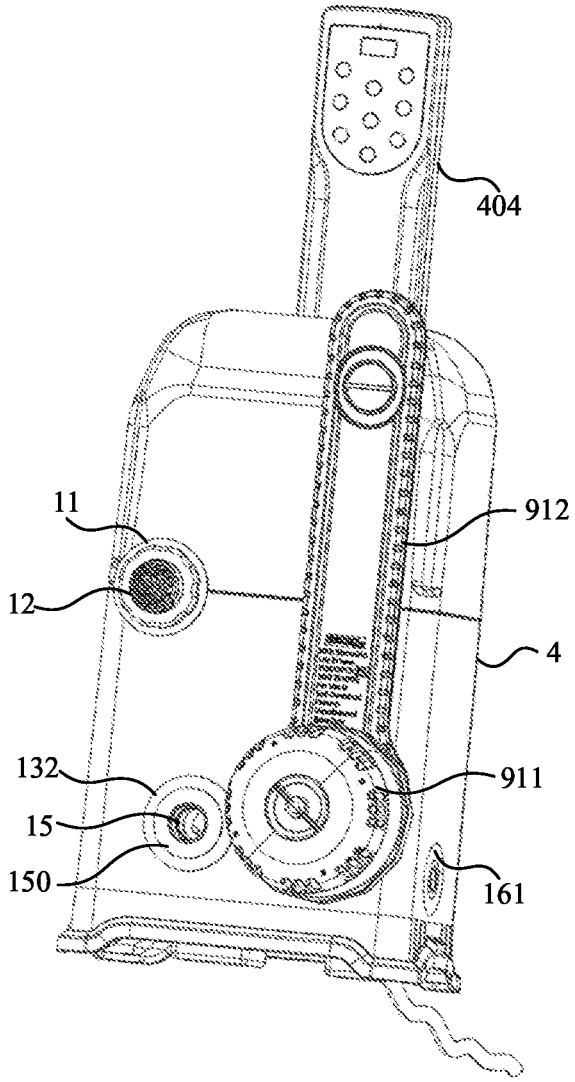
FIG. 21 shows a perspective view of a connection between a control box and a water bypass assembly, in which a pool body is hidden.

With reference to FIGS. 15, 16 and 21, the pool water outlet connector 9 is connected to the filter 911, and the filter 911 is fixed to the inner wall 200 of the pool body. For example, under the action of the water pump 405, the water in the water placement zone of the pool body first flows into the filter 911, and the impurities in the water are filtered by a filter element of the filter 911. The filtered water enters the control box 4, and, optionally, is heated by the heater 406, and then is returned to the water placement zone by means of the control box water inlet connector.

The inflatable massage pool further includes a water bypass assembly 912. The water bypass assembly 912 is fixed to the inner wall 200 of the pool body and is in fluid communication with the filter 911. For example, the water bypass assembly 912 provides communication among other elements by means of a pipeline arranged in the pool wall, such that the water pump 405 is not only in communication with the water in the water placement zone by means of the filter 911, but also in communication with the water in the water placement zone by means of the water bypass assembly 912. When the filter 911 is blocked, the water in the water placement zone may still be sucked into the water pump 405 by means of the water bypass assembly 912. Especially, in a case in which the filter 911 is blocked by hair of a user, existence of the water bypass assembly 912 enables the user to easily leave the filter 911 without danger. In order to prevent the water pump 405 from working abnormally due to the fact that large impurities may be sucked into the water pump 405, the water bypass assembly 912 is optionally provided with a filter screen (not shown in the figure). Alternatively, the water bypass assembly 912 may be further provided with a filter element, or the water bypass assembly 912 may be another filter the same as or approximately the same as the filter 911, so as to improve filtration efficiency of a filtration system.

An example connection between the control box water inlet connector and the pool water inlet connector will be described in detail below in conjunction with the accompanying drawings.

Figure 22:
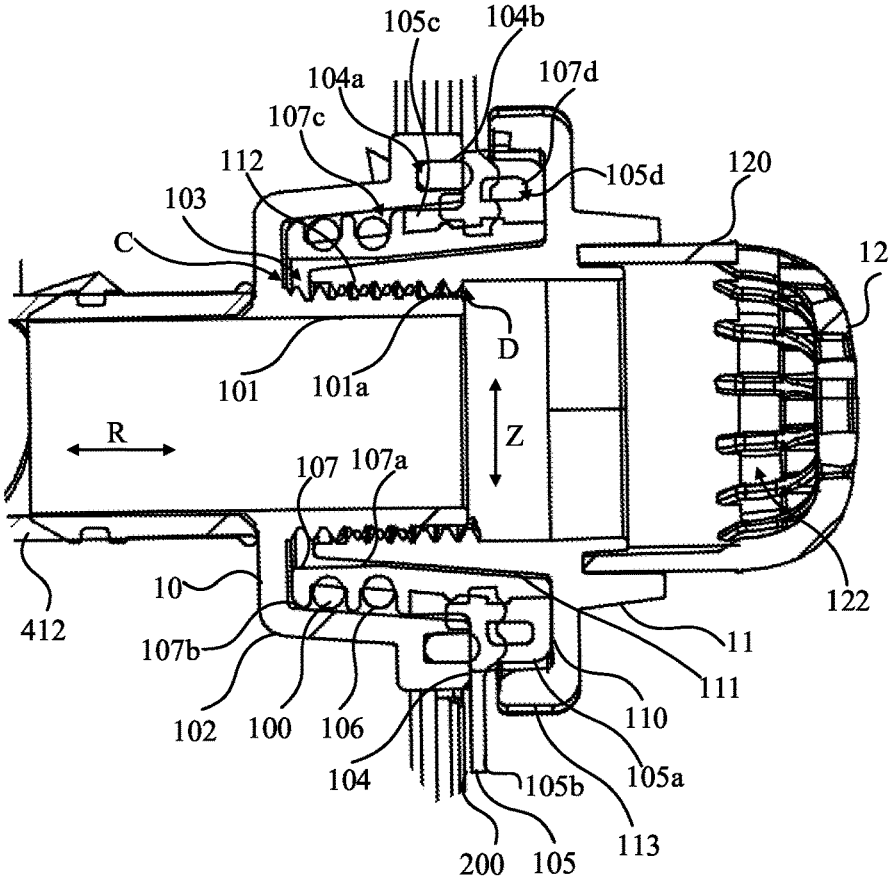
FIG. 22 shows a cross-sectional view of a connection between a control box water inlet connector and a pool water inlet connector.

With reference to FIGS. 12, 14 and 22, the inflatable massage pool further includes a water inlet sealing assembly 100; the control box 4 includes the control box water inlet connector 10; the inner wall 200 of the pool body is provided with the pool water inlet connector 11; and the back side 301 of the control box accommodating cavity 3 is provided with the back hole 308, so as to allow the pool water inlet connector 11 to penetrate the back hole 308 to be connected to the control box water inlet connector 10 in a sealed manner by means of the water inlet sealing assembly 100. The water inlet sealing assembly 100 may simultaneously achieve a sealed connection between the control box water inlet connector 10 and the pool water inlet connector 11 in a radial direction and an axial direction of the control box water inlet connector 10 (the Z direction and the R direction, respectively, in FIG. 22).

Specifically, the water inlet sealing assembly 100 includes a second radial sealing member 106. For example, the second radial sealing member 106 may be an annular sealing ring. With reference to FIGS. 21 and 22, the pool water inlet connector 11 includes a water inlet insertion end 111. For example, the water inlet insertion end 111 may be a hollow tubular structure, and may extend in the axial direction of the control box water inlet connector 10. A radial size of the water inlet insertion end 111 gradually increases in a direction toward an exterior of the control box.

For example, the pool water inlet connector 11 further includes a water inlet limiting part 113. The water inlet limiting part 113 is arranged at a periphery of a first water inlet end surface 110 and extends in the axial direction of the pool water inlet connector 11 so as to protrude from the first water inlet end surface 110.

Figure 23:
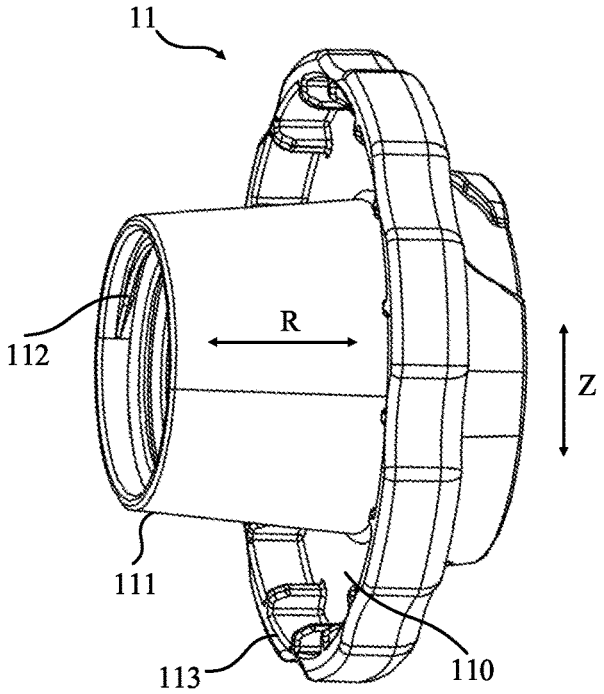
FIG. 23 shows a perspective view of a pool water inlet connector.
Figure 24:
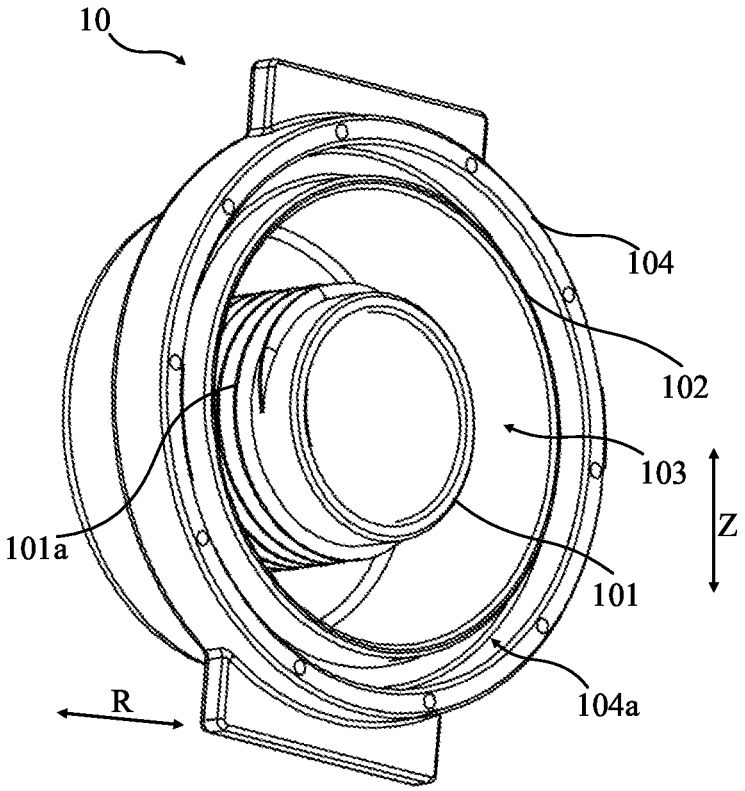
FIG. 24 shows a perspective view of a control box water inlet connector.

With reference to FIGS. 22-24, the control box water inlet connector 10 includes a water inlet slot 103. For example, one end of the water inlet slot 103 in the axial direction of the control box water inlet connector 10 (the R direction in FIG. 22) is closed (as shown in C in FIG. 22) and the other end of the water inlet slot is open (as shown in D in FIG. 22).

The water inlet insertion end 111 is inserted into the water inlet slot 103. The second radial sealing member 106 is arranged between the water inlet insertion end 111 and a slot wall of the water inlet slot 103, and abuts against the water inlet insertion end 111 and the slot wall of the water inlet slot 103 separately, in the radial direction of the pool water inlet connector 11, such that the water inlet insertion end 111 is connected to the water inlet slot 103 in a sealed manner.

With reference to FIGS. 22 and 24, the control box water inlet connector 10 includes an inner control box water inlet connector 101 and an outer control box water inlet connector 102. The outer control box water inlet connector 102 is arranged around the inner control box water inlet connector 101 so as to define the water inlet slot 103. For example, a radial size of the outer control box water inlet connector 102 may be greater than that of the inner control box water inlet connector 101. That is, a distance between the outer control box water inlet connector 102 and the inner control box water inlet connector 101, in the radial direction of the control box water inlet connector 10, forms the water inlet slot 103. One end of the water inlet slot 103 in the axial direction of the control box water inlet connector 10 is open and the other end of the water inlet slot is closed. An opening of the water inlet slot allows the water inlet insertion end 111 to be inserted there into.

The inner control box water inlet connector 101 is hollow and is provided with an outer thread 101*a* on an outer surface, and an inner wall of the water inlet insertion end 111 is provided with an inner thread 112 matching the outer thread 101*a*. For example, when the inner control box water inlet connector 101 is in threaded connection with the water inlet insertion end 111, the second radial sealing member 106 is located between an outer wall of the water inlet insertion end 111 and the slot wall of the water inlet slot 103, such that the water inlet slot 103 is connected to the water inlet insertion end 111 in a sealed manner. It may be understood that the inner control box water inlet connector 101 and the water inlet insertion end 111 may alternately be connected to each other in a sealed manner in any of a number known ways such as, but not limited to, a flange connection or an interference fit connection.

The water inlet sealing assembly 100 further includes a second axial sealing member 105. The pool water inlet connector 11 further includes the first water inlet end surface 110 connected to the water inlet insertion end 111, and the first water inlet end surface 110 extends outward in the radial direction of the pool water inlet connector 11.

The control box water inlet connector 10 further includes a second water inlet end surface 104 connected to the water inlet slot 103, and the second water inlet end surface 104 extends outward in the radial direction of the control box water inlet connector 10. For example, the second water inlet end surface 104 may be annular.

The first water inlet end surface 110 and the second water inlet end surface 104 are arranged opposite each other and are spaced apart in the axial direction of the control box water inlet connector 10 (the R direction of FIG. 22). The second axial sealing member 105 is located between the first water inlet end surface 110 and the second water inlet end surface 104, and is connected in a sealed manner to the first water inlet end surface 110 and the second water inlet end surface 104, separately, in the axial direction of the control box water inlet connector 10.

Figure 25:
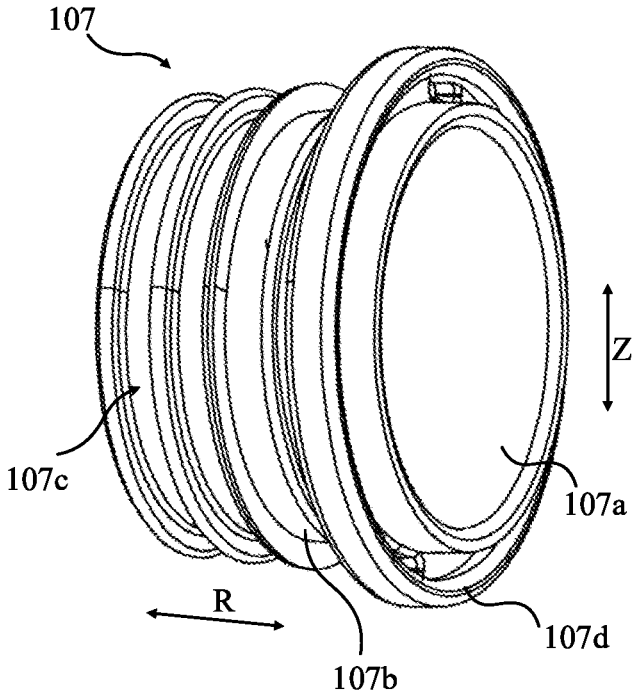
FIG. 25 shows a perspective view of a water inlet fixing member.

According to an example embodiment, and with reference to FIGS. 22 and 25, the inflatable massage pool further includes a water inlet fixing member 107; at least a part of the water inlet fixing member 107 is located in the water inlet slot 103; and an inner wall 107*a* of the water inlet fixing member 107 abuts against the outer wall of the water inlet insertion end 111 in the radial direction of the control box water inlet connector 10 (the Z direction of FIG. 22). An outer wall 107*b* of the water inlet fixing member 107 abuts against the slot wall of the water inlet slot 103 in the radial direction of the control box water inlet connector 10. That is, the water inlet insertion end 111 and the water inlet fixing member 107 jointly achieve sealing between the control box water inlet connector 10 and the pool water inlet connector 11. An outer diameter of the water inlet insertion end 111 gradually decreases in a direction away from the first water inlet end surface 110, such that the water inlet fixing member 107 is gradually pressed as the water inlet insertion end 111 is fastened to the inner control box water inlet connector 101.

The outer wall 107*b* of the water inlet fixing member 107 is provided with a water inlet sealing clamping groove 107*c*, and the water inlet sealing clamping groove 107*c* accommodates the second radial sealing member 106 therein. The second radial sealing member 106 is pressed between the water inlet fixing member 107 and the inner wall of the outer control box water inlet connector 102, so as to form a sealed connection between the control box water inlet connector 10 and the pool water inlet connector 11. There are two or more water inlet sealing clamping grooves 107*c*, and each of the water inlet sealing clamping grooves 107*c* accommodates one second radial sealing member 106, such that a sealing effect can still be ensured when any second radial sealing member 106 fails.

Figure 26:
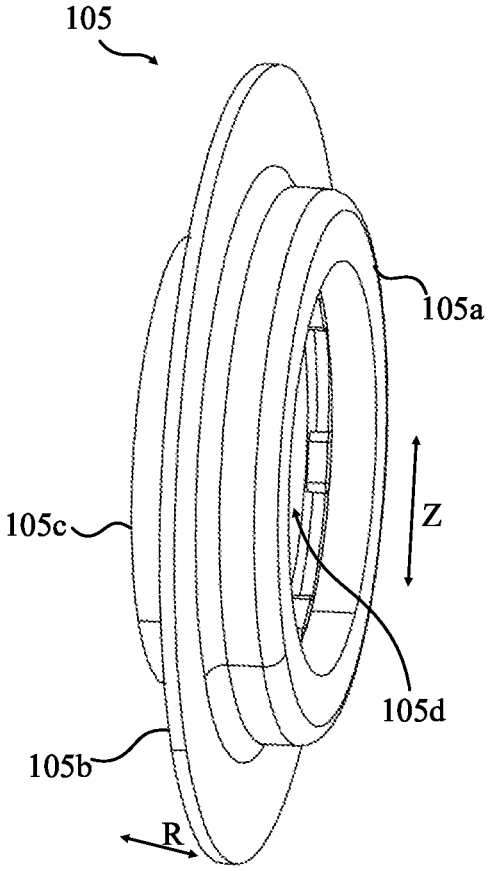
FIG. 26 shows a perspective view of a second axial sealing member.

With reference to FIGS. 22 and 26, the second axial sealing member 105 includes a third protrusion 105*a*, and an inner wall of the third protrusion 105*a* is provided with a fourth clamping groove 105*d*. The outer wall 107*b* of the water inlet fixing member 107 is provided with a second clamping part 107*d* in a protruding manner. The second clamping part 107*d* is connected to the fourth clamping groove 105*d* in a clamped manner. The third protrusion 105*a* covers the second clamping part 107*d*, such that relative positions of the second axial sealing member 105 and the water inlet fixing member 107 are fixed, and sealing is provided.

The second axial sealing member 105 includes a third connection part 105*b* and a fourth protrusion 105*c*. The third protrusion 105*a* and the fourth protrusion 105*c* are located at opposite ends of the third connection part 105*b* in the axial direction of the second axial sealing member 105 (the R direction in FIG. 22). For example, a radial size of the third protrusion 105*a* may be greater than that of the fourth protrusion 105*c*. The water inlet limiting part 113 presses the third protrusion 105*a*. The fourth protrusion 105*c* is clamped between the outer wall 107*b* of the water inlet fixing member 107 and the slot wall of the water inlet slot 103 in the radial direction of the second axial sealing member 105 (the Z direction in FIG. 22). The third connection part 105*b* extends outward in the radial direction of the second axial sealing member 105 so as to be attached to the inner wall 200 of the pool body. For example, a surface of the third connection part 105*b* and the inner wall 200 of the pool body may be welded and sealed to prevent water from leaking from a joint between the second water inlet end surface 104 and the third connection part 105*b*.

With reference to FIGS. 22 and 24, one side of the second water inlet end surface 104 facing the third connection part 105*b* is provided with a second water inlet clamping groove 104*a*; the second water inlet clamping groove 104*a* accommodates therein a first water inlet sealing ring 104*b*; and the first water inlet sealing ring 104*b* abuts against the third connection part 105*b*.

With reference to FIGS. 11, 21 and 22, a protective cover 12 is connected to the pool water inlet connector 11 in a clamped manner, so as to prevent objects in the water placement zone from entering the control box 4. The protective cover 12 is provided with a plurality of water inlet holes 122 and is connected, in a clamped manner, to the pool water inlet connector 11 by means of its columnar part 120.

With reference to FIGS. 11, 13 and 15, the control box 4 is internally provided with a control box air inlet connector, and the inner wall 200 of the pool body is provided with a pool air inlet connector 15. One end of the pool air inlet connector 15 penetrates an air inlet hole 409 of the front end surface 408 of the control box 4, so as to be in communication with the control box air inlet connector, and the other end of the pool air inlet connector 15 is in fluid communication with a connection channel 152 of the pool body. The air pump 403 sucks air from the outside, pressurizes the air, and then conveys the air to a wave making channel 151 via the connection channel 152. The pressurized air supplies bubbles to a water storage zone via air injection holes 153 distributed on the wave making channel 151 so as to produce a massage effect.

An example connection between the control box air inlet connector and the pool air inlet connector will be described in detail below in conjunction with the accompanying drawings.

With reference to FIGS. 27-29 and FIGS. 12 and 14, the inflatable massage pool further includes an air inlet sealing assembly 13; the control box 4 includes a control box air inlet connector 14; the inner wall 200 of the pool body is provided with a pool air inlet connector 15; the back side 301 of the control box accommodating cavity 3 is provided with the back hole 308; the front end surface 408 of the control box 4 is provided with the air inlet hole 409; the back hole 308 is in communication with the air inlet hole 409, so as to allow the pool air inlet connector 15 to penetrate the back hole 308 and extend into the control box 4; and the control box air inlet connector 14 is connected to the pool air inlet connector 15 in a sealed manner by means of the air inlet sealing assembly 13. The air inlet sealing assembly 13 provides sealing between the control box air inlet connector 14 and the pool air inlet connector 15.

Figure 27:
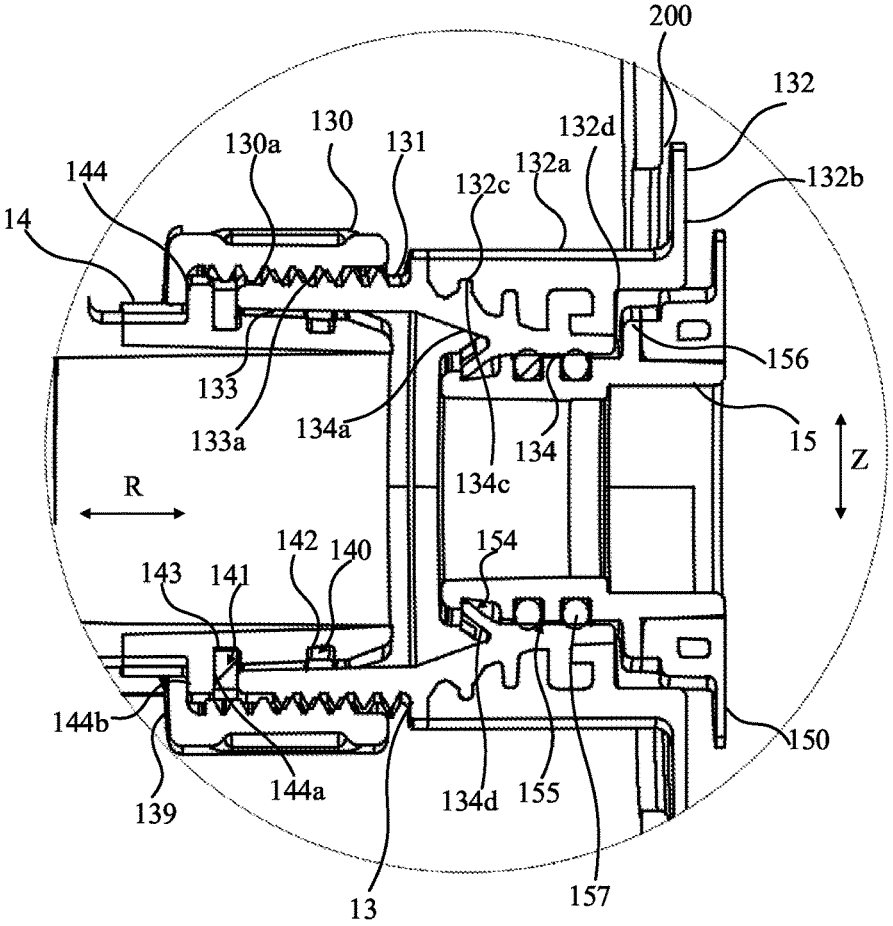
FIG. 27 shows a cross-sectional view of a connection between a control box air inlet connector and a pool air inlet connector.
Figure 30:
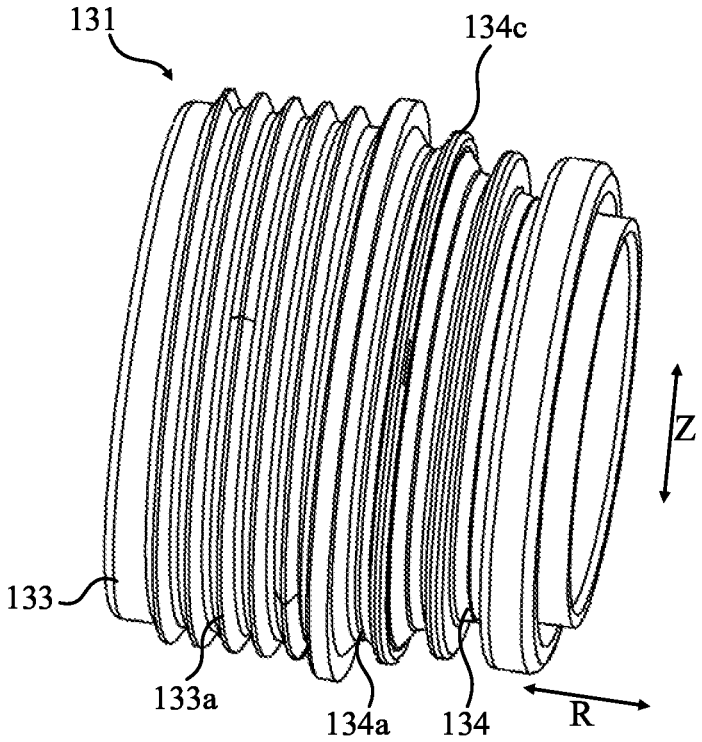
FIG. 30 shows a perspective view of a radial sealing connector.

With reference to FIGS. 27 and 30, the air inlet sealing assembly 13 includes a radial sealing connector 131. The radial sealing connector includes a first air inlet end 133 and a second air inlet end 134. In an axial direction of the radial sealing connector 131 (an R direction in FIG. 27), the control box air inlet connector 14 is sleeved with the first air inlet end 133, and the pool air inlet connector 15 is sleeved with the second air inlet end 134. An inner wall of the first air inlet end 133 is connected, in a sealed manner, to an outer wall of the control box air inlet connector 14 in a radial direction of the radial sealing connector 131 (a Z direction in FIG. 27), and an end of the first air inlet end 133 is connected, in a sealed manner, to the outer wall of the control box inflation connector 14 in the axial direction of the radial sealing connector 131. An inner wall of the second air inlet end 134 is connected, in a sealed manner, to an outer wall of the pool air inlet connector 15 in the radial direction of the radial sealing connector 131. That is, the control box air inlet connector 14 and the pool air inlet connector 15 are sleeved with the radial sealing connector 131 at a same time, such that the control box air inlet connector 14 is connected to the pool air inlet connector 15.

For example, the radial sealing connector 131 further includes a contraction part 134*a*. One end of the contraction part 134*a* is connected to the first air inlet end 133 and the other end of the contraction part is connected to the second air inlet end 134.

For example, both the first air inlet end 133 and the second air inlet end 134 may be hollow tubular structures having equal diameters. Specifically, if a radial size of the first air inlet end 133 is greater than that of the second air inlet end 134, a radial size of the contraction part 134*a* gradually decreases in the axial direction of the radial sealing connector 131, facing the pool body. That is, the radial size of the contraction part 134*a* gradually decreases from a maximum radial size at a joint with the first air inlet end 133 to a minimum radial size at a joint with the second air inlet end 134.

Figure 28:
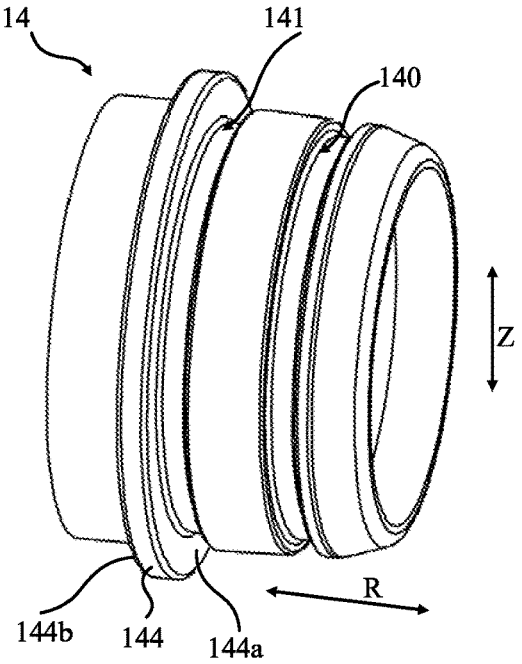
FIG. 28 shows a perspective view of a control box air inlet connector.

With reference to FIGS. 27 and 28, the air inlet sealing assembly 13 further includes a first air inlet sealing ring 142. The inner wall of the first air inlet end 133 or the outer wall of the control box air inlet connector 14 is provided with a first air inlet clamping groove 140, and the first air inlet clamping groove 140 accommodates the first air inlet sealing ring 142. Optionally, the first air inlet clamping groove 140 may be provided on the outer wall of the control box air inlet connector 14, and the inner wall of the first air inlet end 133 and the first air inlet clamping groove 140 may press the first air inlet sealing ring 142, such that the first air inlet end 133 of the radial sealing connector 131 is connected to the control box air inlet connector 14 in a sealed manner. Further, gas may be prevented from leaking from a joint between the control box air inlet connector 14 and the radial sealing connector 131.

The air inlet sealing assembly 13 further includes a second air inlet sealing ring 143. The outer wall of the control box air inlet connector 14 is provided with a second air inlet clamping groove 141, and the second air inlet clamping groove 141 accommodates the second air inlet sealing ring 143. For example, the first air inlet clamping groove 140 and the second air inlet clamping groove 141 are spaced apart from each other in an axial direction of the control box air inlet connector 14 (the R direction in FIG. 27). Specifically, the first air inlet clamping groove 140 may be closer to the pool air inlet connector 15 than is the second air inlet clamping groove 141.

The outer wall of the control box air inlet connector 14 is provided with an air inlet limiting part 144 in a protruding manner. In the axial direction of the control box air inlet connector 14 (the R direction in FIG. 27), the air inlet limiting part 144 and an end of the first air inlet end 133 of the radial sealing connector 131 jointly clamp the second air inlet sealing ring 143. For example, the air inlet limiting part 144 may be arranged around the outer wall of the control box air inlet connector 14, and a radial size of the air inlet limiting part 144 may be greater than an outer contour size of the control box air inlet connector 14.

For example, one groove wall of the second air inlet clamping groove 141 in the axial direction of the control box air inlet connector 14 is a first wall 144*a* of the air inlet limiting part 144, and the other groove wall of the second air inlet clamping groove is flush with the end of the first air inlet end 133 in the radial direction of the control box air inlet connector 14. In this way, the second air inlet sealing ring 143 in the second air inlet clamping groove 141 may be pressed by the first wall 144*a* of the air inlet limiting part 144 and by the end of the first air inlet end 133, separately in the axial direction of the control box air inlet connector 14, and then the control box air inlet connector 14 is connected to the radial sealing connector 131 in the axial direction of the control box air inlet connector 14 in a sealed manner.

Figure 31:
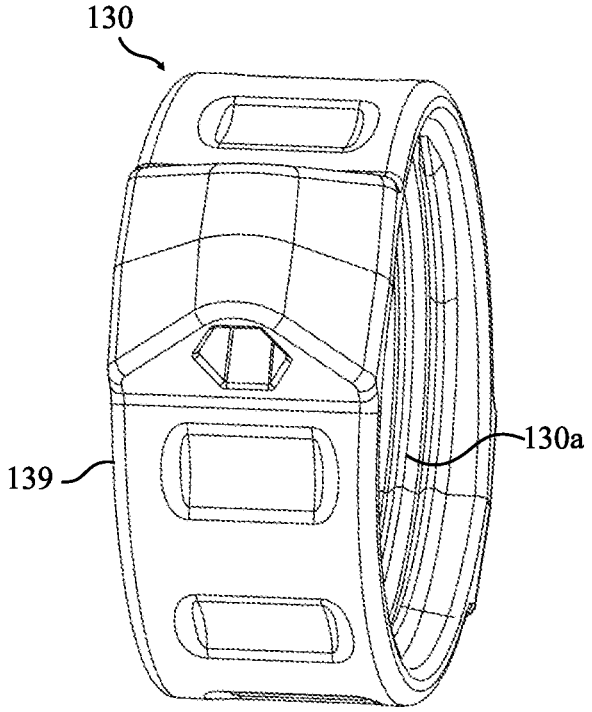
FIG. 31 shows a perspective view of a threaded fastener.

With reference to FIGS. 27 and 31, the inflatable massage pool further includes a threaded fastener 130. The first air inlet end 133 of the radial sealing connector 131 is sleeved with the threaded fastener 130, and the threaded fastener is in threaded connection with the first air inlet end 133. The first air inlet end 133 is provided with an outer thread 133*a*, and the threaded fastener 130 is provided with an inner thread 130*a* matching the outer thread 133*a*.

With reference to FIG. 27, the threaded fastener 130 includes a first stop part 139, and the first stop part 139 extends in the radial direction of the threaded fastener 130 (the Z direction in FIG. 27). The air inlet limiting part 144 includes a first side 144*a* and a second side 144*b* facing away from each other in its axial direction (the R direction in FIG. 27). The first side 144*a* faces the second air inlet sealing ring 143 in the axial direction of the threaded fastener 130, and the second side 144*b* abuts against the first stop part 139.

Figure 29:
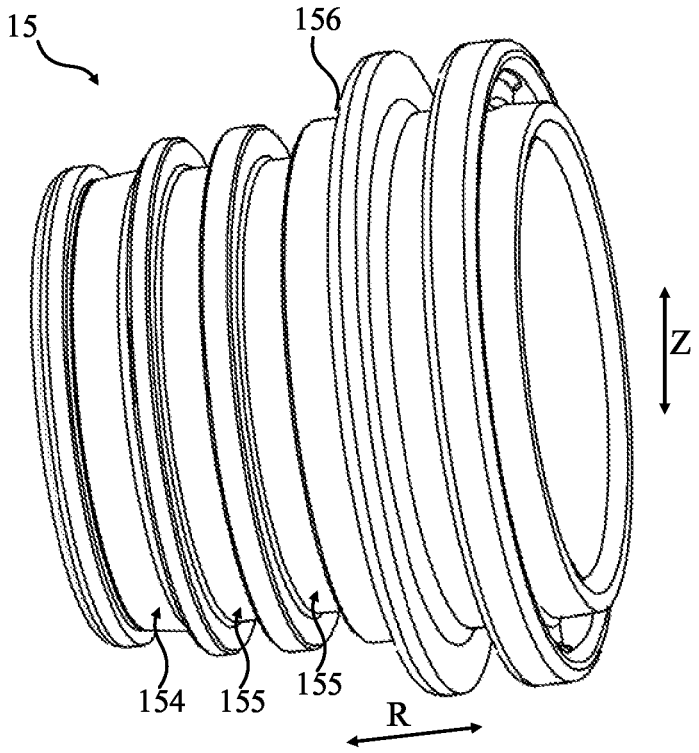
FIG. 29 shows a perspective view of a pool air inlet connector.

With reference to FIGS. 27 and 29, the air inlet sealing assembly 13 further includes a third air inlet sealing ring 157. The outer wall of the pool air inlet connector 15 or the inner wall of the second air inlet end 134 of the radial sealing connector 131 is provided with an air inlet sealing clamping groove 155, and the air inlet sealing clamping groove 155 accommodates the third air inlet sealing ring 157. Optionally, the air inlet sealing clamping groove 155 may be provided on the outer wall of the pool air inlet connector 15, and the inner wall of the second air inlet end 134 of the radial sealing connector 131 may press the third air inlet sealing ring 157, such that the second air inlet end 134 of the radial sealing connector 131 is connected to the pool air inlet connector 15 in a sealed manner.

For example, two or more air inlet sealing clamping grooves 155 may be provided to accommodate a corresponding number of third air inlet sealing rings 157, so as to achieve a better sealing effect.

The inner wall of the second air inlet end 134 of the radial sealing connector 131 is connected to the outer wall of the pool air inlet connector 15 in a clamped manner. Specifically, the inner wall of the second air inlet end 134 of the radial sealing connector 131 includes an air inlet clamping part 134*d*, and the outer wall of the pool air inlet connector 15 includes a first air inlet connection clamping groove 154. The air inlet clamping part 134*d* is connected to the first air inlet connection clamping groove 154 in a clamped manner. The air inlet clamping part 134*d* is obliquely arranged facing the first air inlet connection clamping groove 154 and abuts against a groove wall of the first air inlet connection clamping groove 154. That is, the air inlet clamping part 134*d* is connected to the first air inlet connection clamping groove 154 in a clamped manner, such that the radial sealing connector 131 and the pool air inlet connector 15 are fixed relative to each other, and thus the radial sealing connector 131 is prevented from falling off from the pool air inlet connector 15.

For example, the first air inlet connection clamping groove 154 and the air inlet sealing clamping groove 155 are spaced apart from each other in the axial direction of the pool air inlet connector 15.

Figure 32:
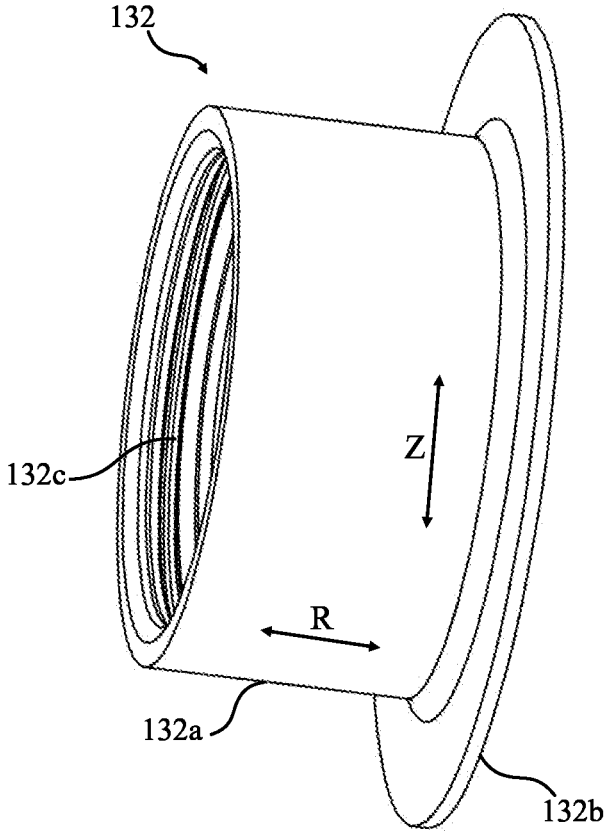
FIG. 32 shows a perspective view of an axial sealing connector.

With reference to FIGS. 27 and 32, the inflatable massage pool further includes an axial sealing connector 132. The axial sealing connector 132 includes an inner air inlet connection part 132*a*. The outer wall of the second air inlet end 134 of the radial sealing connector 131 is sleeved with the inner air inlet connection part 132*a*, and the inner air inlet connection part is connected to the outer wall of the second air inlet end 134 in a clamped manner. Optionally, the contraction part 134*a* and the second air inlet end 134 may be sleeved with the inner air inlet connection part 132*a* at the same time.

For example, an inner periphery of the inner air inlet connection part 132*a* is provided with a plurality of recesses 132*c*; outer peripheries of the contraction part 134*a* and the second air inlet end 134 are provided with a plurality of protrusions 134*c*; and the plurality of recesses 132*c* are connected to the plurality of protrusions 134*c* in a clamped manner, such that the axial sealing connector 132 and the radial sealing connector 131 are fixed relative to each other. However, the manner of connection is not limited. For example, the inner periphery of the inner air inlet connection part 132*a* may be provided with a plurality of protrusions; the outer peripheries of the contraction part 134*a* and the second air inlet end 134 are provided with a plurality of recesses; and the axial sealing connector 132 is connected to the radial sealing connector 131 through a concave-convex fit. Alternately, connection may be provided according to any of a numbers of ways, as would be understood by one of skill in the art.

The axial sealing connector 132 further includes an outer air inlet sealing end surface 132*b*. The outer air inlet sealing end surface 132*b* is connected to the inner air inlet connection part 132*a*. The outer air inlet sealing end surface 132*b* is attached to the inner wall 200 of the pool body in the axial direction of the axial sealing connector 132 (the R direction in FIG. 27). For example, the outer air inlet sealing end surface 132*b* may be welded to the inner wall 200 of the pool body, such that gas is prevented from leaking between the outer air inlet sealing end surface 132*b* and the inner wall 200 of the pool body.

For example, the outer wall of the pool air inlet connector 15 may be provided with an air inlet protrusion 156 in a protruding manner, and the second air inlet end 134 and one end of the inner connection part 132*a* facing the pool body may be flush with each other in the radial direction of the pool air inlet connector 15 and may abut against the air inlet protrusion 156.

According to an example embodiment, with reference to FIGS. 27 and 29, the inflatable massage pool further includes an air inlet connector 150. The pool air inlet connector 15 is sleeved with the air inlet connector 150. The outer wall of the pool air inlet connector 15 is provided with the air inlet protrusion 156 in a protruding manner. The inner air inlet connection part 132*a* of the axial sealing connector 132 includes an annular end part 132*d*. The annular end part 132*d* is arranged at one side of the inner air inlet connection part 132*a* in the axial direction of the pool air inlet connector 15 and facing the pool body (the R direction in FIG. 27). The annular end part 132*d* and the end of the air inlet connector 150 in the axial direction of the pool air inlet connector 15 and facing an interior of the control box jointly clamp the air inlet protrusion 156. The annular end part 132*d* and the outer air inlet sealing end surface 132*b* are spaced apart from each other in the axial direction of the pool air inlet connector 15.

For example, with reference to FIGS. 11 and 27, an outer end surface of the air inlet connector 150 and the outer sealing end surface 132*b* of the axial sealing connector 132 may be oppositely arranged in the axial direction of the pool air inlet connector 15. The air inlet connector 150 may be configured to be connected to the connection channel 152 connected to the wave making channel 151, such that gas from the air pump in the control box enters the wave making channel 151, and a wave-making massage function is provided for a user.

Before an inflatable massage pool is used, the inflatable chamber is inflated by using the air pump in the control box, such that the inflatable massage pool expands to a set shape, so as to form the water placement zone for accommodating water. Specifically, the control box of the inflatable massage pool may be in fluid communication with the inflatable chamber. That is, the air pump in the control box may pump gas into the inflatable chamber via a control box inflation connector and an accommodating cavity inflation connector of the control box accommodating cavity, so as to inflate the inflatable chamber.

An example connection between the control box inflation connector and the accommodating cavity inflation connector of the control box accommodating cavity will be described in detail below in conjunction with the accompanying drawings.

Figure 33:
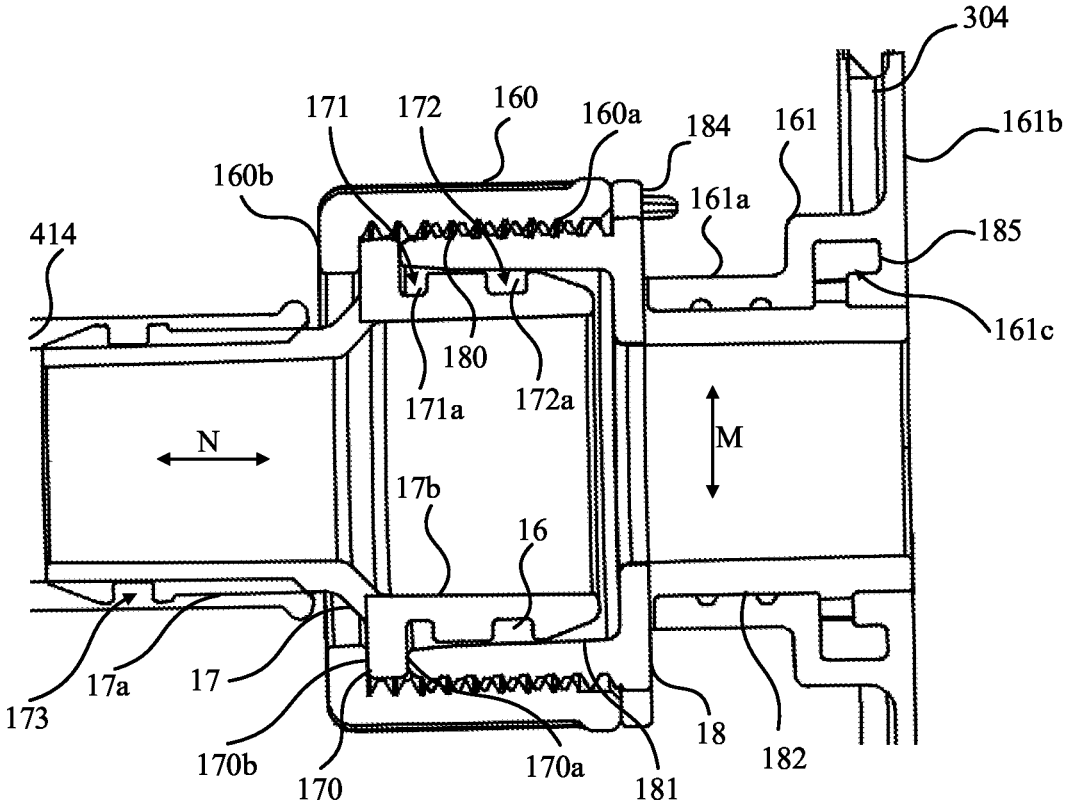
FIG. 33 shows a cross-sectional view of a connection between a control box inflation connector and an accommodating cavity inflation connector.
Figure 34:
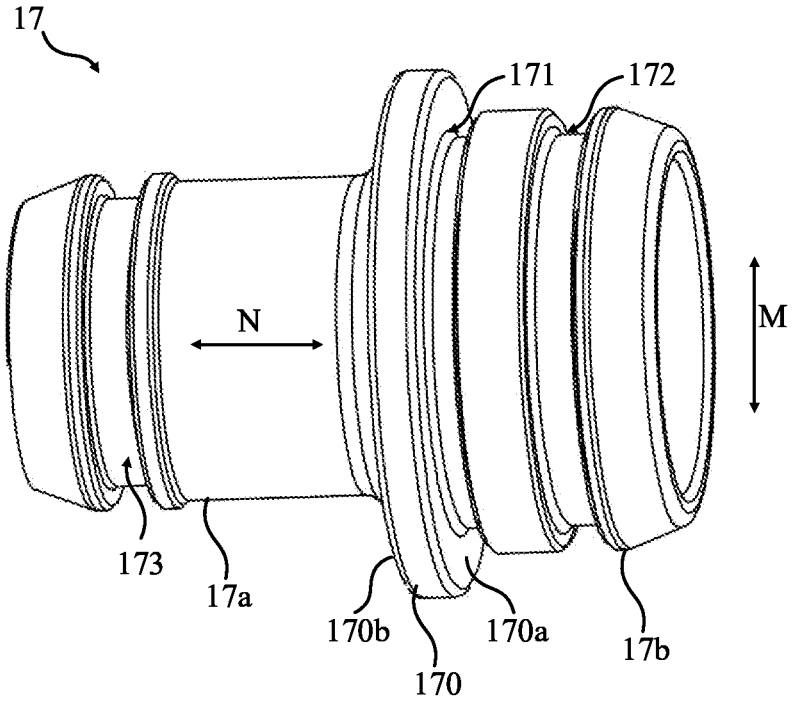
FIG. 34 shows a perspective view of a control box inflation connector.
Figure 35:
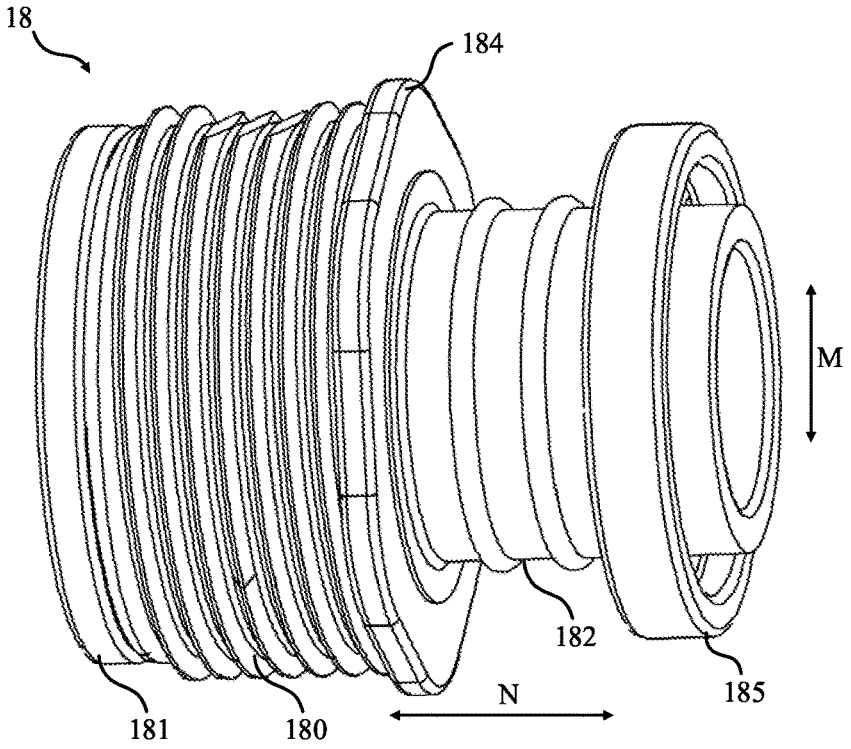
FIG. 35 shows a perspective view of an accommodating cavity inflation connector.

With reference to FIGS. 33-35 and in conjunction with FIGS. 12 and 14, the inflatable massage pool further includes an inflation sealing assembly 16; the control box 4 includes the control box inflation connector 17; a side wall 305 of the control box accommodating cavity 3 is provided with the accommodating cavity inflation connector 18; and the control box 4 is provided with an inner inflation hole 407, such that the accommodating cavity inflation connector 18 extends into the inner inflation hole 407 to be connected to the control box inflation connector 17 by means of the inflation sealing assembly 16 in a sealed manner.

With reference to FIGS. 33-35, the accommodating cavity inflation connector 18 includes a first connection part 181; the control box inflation connector 17 includes an inflation insertion end 17*b*; the inflation insertion end 17*b* is sleeved with the first connection part 181; and an inner wall of the first connection part 181 is connected to an outer wall of the inflation insertion end 17*b* in a sealed manner in a radial direction of the accommodating cavity inflation connector 18 (an M direction in FIG. 33).

With reference to FIG. 33 and in conjunction with FIG. 15, for example, the control box inflation connector 17 may further include a pipeline connection end 17*a*, and the pipeline connection end 17*a* may be connected to the inflation insertion end 17*b*. The pipeline connection end 17*a* is inserted into an inflation pipe 414, and an outer wall of the pipeline connection end 17*a* is provided with an inflation connection clamping groove 173, so as to accommodate a sealing ring, such that the control box inflation connector 17 is connected to the inflation pipe 414 in a sealed manner.

With reference to FIGS. 33 and 34, the inflation sealing assembly 16 includes a first inflation sealing ring 172*a*. The inner wall of the first connection part 181 or the outer wall of the inflation insertion end 17*b* is provided with a first inflation clamping groove 172. The first inflation clamping groove 172 accommodates the first inflation sealing ring 172*a* therein. Optionally, the first inflation clamping groove 172 may be provided on the outer wall of the inflation insertion end 17*b*, and the inner wall of the first connection part 181 may press the first inflation sealing ring 172*a* in the first inflation clamping groove 172 in the radial direction of the control box inflation connector 17, such that the inner wall of the first connection part 181 is closely attached to the outer wall of the inflation insertion end 17*b*, and thus the control box inflation connector 17 is connected to the accommodating cavity inflation connector 18 in a sealed manner.

The inflation sealing assembly 16 further includes a second inflation sealing ring 171*a*. The inner wall of the first connection part 181 or the outer wall of the inflation insertion end 17*b* is provided with a second inflation clamping groove 171. The second inflation clamping groove 171 accommodates the second inflation sealing ring 171*a* therein. For example, the first inflation clamping groove 172 and the second inflation clamping groove 171 are spaced apart from each other in an axial direction of the control box inflation connector 17 (an N direction in FIG. 24).

Optionally, the second inflation clamping groove 171 may be provided on the outer wall of the inflation insertion end 17*b*, and the inner wall of the first connection part 181 may press the second inflation sealing ring 171*a* in the second inflation clamping groove 171 in the radial direction of the accommodating cavity inflation connector 18, such that the inner wall of the first connection part 181 is closely attached to the outer wall of the inflation insertion end 17*b*, and thus the control box inflation connector 17 is connected to the accommodating cavity inflation connector 18 in a sealed manner.

The outer wall of the inflation insertion end 17*b* is provided with an inflation limiting part 170 in a protruding manner. In the axial direction of the accommodating cavity inflation connector 18 (the N direction in FIG. 33), the inflation limiting part 170 and the inner wall of the first connection part 181 jointly clamp the second inflation sealing ring 171*a*. For example, the inflation limiting part 170 may be arranged around the outer wall of the inflation insertion end 17*b*, and an outer contour size of the inflation limiting part 170 may be greater than that of the inflation insertion end 17*b*.

The inflation limiting part 170 includes a first limiting wall 170*a* and a second limiting wall 170*b* facing away from each other in the axial direction of the accommodating cavity inflation connector 18, and the first limiting wall 170*a* is also a groove wall of the second inflation clamping groove 171. The first limiting wall 170*a* abuts against an end of the first connection part 181 of the accommodating cavity inflation connector 18 in the axial direction of the accommodating cavity inflation connector 18, such that the second inflation sealing ring 171*a* is pressed together by the inner wall of the first connection part 181 and the first limiting wall 170*a*, and thus the control box inflation connector 17 is connected to the accommodating cavity inflation connector 18 in a sealed manner.

With reference to FIG. 33, the inflatable massage pool further includes an inflation fastener 160. The first connection part 181 of the accommodating cavity inflation connector 18 is sleeved with the inflation fastener 160, and the inflation fastener is in threaded connection with the first connection part 181. For example, the outer wall of the first connection part 181 of the accommodating cavity inflation connector 18 is provided with an outer thread 180, and the inner wall of the inflation fastener 160 is provided with an inner thread 160*a*. The outer thread 180 is connected to the inner thread 160*a*.

That is, the first connection part 181 of the accommodating cavity inflation connector 18 is clamped by the inflation fastener 160 and the inflation insertion end 17*b* of the control box inflation connector 17, such that relative movement of the control box inflation connector 17 and the accommodating cavity inflation connector 18 is limited, and then connection reliability of the control box inflation connector 17 and the accommodating cavity inflation connector 18 is aided.

The inflation fastener 160 includes a first inflation stop part 160*b*. The first inflation stop part 160*b* extends in the radial direction of the control box inflation connector 17 (the M direction in FIG. 33). In the axial direction of the control box inflation connector 17 (the N direction in FIG. 33), two ends of the inflation limiting part 170 abut against the first inflation stop part 160*b* and the end of the first connection part 181 of the accommodating cavity inflation connector 18, respectively. Specifically, the first limiting wall 170*a* of the inflation limiting part 170 abuts against the end of the first connection part 181 of the accommodating cavity inflation connector 18, and the second limiting wall 170*b* abuts against the first inflation stop part 160*b*, such that relative fixation of the control box inflation connector 17, the accommodating cavity inflation connector 18 and the inflation fastener 160 is achieved, and then a sealed connection between the control box inflation connector 17 and the accommodating cavity inflation connector 18 is aided.

With reference to FIGS. 33 and 35, the first connection part 181 of the accommodating cavity inflation connector 18 includes a second inflation stop part 184. The second inflation stop part 184 extends in the radial direction of the accommodating cavity inflation connector 18. The second inflation stop part 184 abuts against one end of the inflation fastener 160 in the axial direction of the accommodating cavity inflation connector 18 (the N direction in FIG. 33) and away from the first inflation stop part 160*b*. That is, on the basis of a threaded connection between the first connection part 181 of the accommodating cavity inflation connector 18 and the inflation fastener 160, the second inflation stop part 184 abuts against the end of the inflation fastener, and thus further the inflation fastener 160 and the first connection part 181 are fixed relative to each other, so as to prevent the inflation fastener 160 from being disengaged from the first connection part 181.

Figure 36A:
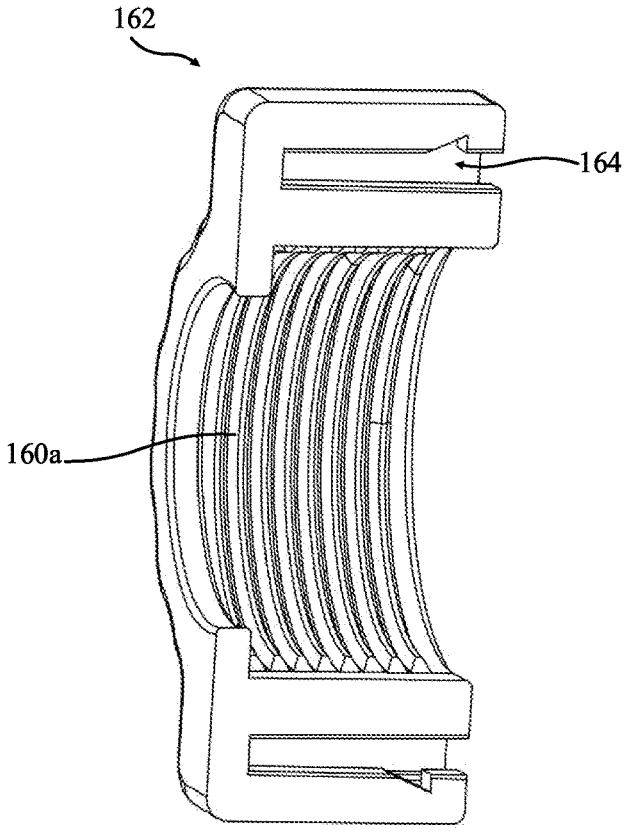
FIG. 36*a* is a perspective view of a first fastener.
Figure 36B:
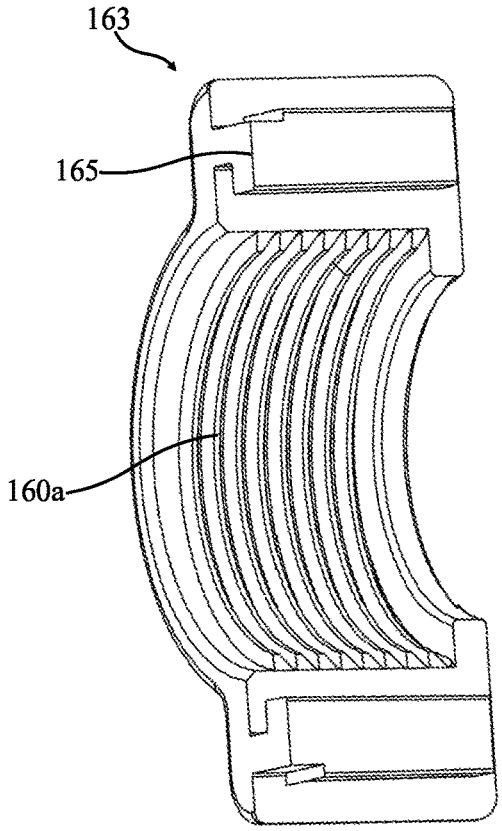
FIG. 36*b* is a perspective view of a second fastener.

With reference to FIGS. 33, 36*a* and 36*b*, the inflation fastener 160 includes a first fastener 162 and a second fastener 163. The first fastener 162 is provided with an inflation clamping groove 164, and the second fastener 163 is provided with an inflation protrusion 165. The inflation protrusion 165 is connected to the inflation clamping groove 164 in a clamped manner. For example, both the first fastener 162 and the second fastener 163 are semicircular, and the first fastener 162 and the second fastener 163 are spliced to form a complete inflation fastener 160. The inflation fastener 160 fastens the connection between the control box inflation connector 17 and the accommodating cavity inflation connector 18 so as to prevent the control box inflation connector 17 and the accommodating cavity inflation connector 18 from being disengaged.

Figure 37:
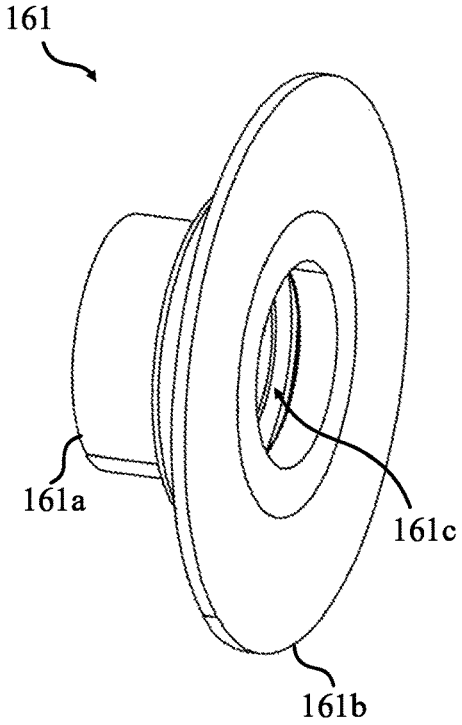
FIG. 37 shows a perspective view of an inflation sealing member.

With reference to FIGS. 33 and 37, the inflatable massage pool further includes an axial inflation sealing member 161; the axial inflation sealing member 161 includes an inner inflation connection part 161*a*; and the accommodating cavity inflation connector 18 further includes a second connection part 182 connected to the first connection part 181. The second connection part 182 is sleeved with the inner inflation connection part 161*a*, and the inner inflation connection part is connected to the second connection part 182 in a clamped manner.

For example, an inner wall of the inner inflation connection part 161*a* is provided with an inflation sealing clamping groove 161*c*; an outer wall of the second connection part 182 is provided with an inflation clamping part 185 in a protruding manner; and the inflation clamping part 185 is connected to the inflation sealing clamping groove 161*c* of the inner inflation connection part 161*a* in a clamped manner, such that the axial inflation sealing member 161 and the accommodating cavity inflation connector 18 are fixed and sealed relative to each other.

With reference to FIGS. 33 and 36 in conjunction with FIG. 12, the axial inflation sealing member 161 further includes an outer inflation sealing end surface 161*b*. The outer inflation sealing end surface 161*b* is connected to the inner inflation connection part 161*a*. The outer inflation sealing end surface 161*b* extends outward in the radial direction of the accommodating cavity inflation connector 18 (the M direction in FIG. 24) so as to be attached and connected to the side wall 305 of the control box accommodating cavity in the axial direction of the accommodating cavity inflation connector 18 (the N direction in FIG. 33). For example, the outer inflation sealing end surface 161*b* is fixed to the side wall 305 of the control box accommodating cavity through welding, such that gas is prevented from leaking from the joint between the accommodating cavity inflation connector 18 and the side wall 305 of the control box accommodating cavity.

It may be understood that the example embodiments described herein may be considered in a descriptive sense only and not for purposes of limitation. Descriptions of features or aspects within each example embodiment may be considered as available for other similar features or aspects in other example embodiments.

While example embodiments have been described with reference to the figures, it will be understood by those of ordinary skill in the art that various changes in form and details may be made therein without departing from the spirit and scope as defined by the following claims.

What is claimed is:

1. An inflatable pool comprising:
- a top wall;
- a pool bottom;
- an outer wall connected to the top wall and the pool bottom;
- an inner wall connected to the top wall and the pool bottom;
- an inflatable chamber defined by the top wall, the pool bottom, the outer wall and the inner wall;
- an accommodating wall connected to the inner wall and to the outer wall;
- an accommodating cavity defined by the accommodating wall and isolated from the inflatable chamber; and
- a protective wall disposed in the accommodating cavity and connected to the outer wall and the inner wall; and
- a control box disposed in the accommodating cavity;
- wherein the protective wall is disposed between the accommodating wall and the control box.

2. The inflatable pool according to claim 1, wherein the accommodating wall comprises an upper wall portion disposed parallel to the top wall of the pool wall.

3. The inflatable pool according to claim 1, wherein the accommodating wall comprises a side wall portion shaped to surround the control box.

4. The inflatable pool according to claim 1, further comprising an opening in the pool bottom through which the control box may be inserted.

5. The inflatable pool according to claim 1,
- wherein the control box comprises a control panel, and
- wherein the outer wall comprises an opening therein through which the control panel extends from an interior of the accommodating chamber.

6. The inflatable pool according to claim 1,
- wherein the inner wall comprises a pool wall water inlet and a pool wall water outlet;
- wherein the control box comprises: a control box water inlet, in communication with the pool wall water inlet, and a control box water outlet, in communication with the pool wall water outlet; and
- wherein the control box is configured to circulate water in a water receptacle, defined by the inner wall and the pool bottom, via the control box water inlet, the pool wall water inlet, the control box water outlet, and the pool wall water outlet.

7. The inflatable pool according to claim 6, further comprising:
- a water outlet sealing assembly sealing the pool wall water outlet to the control box water outlet;
- wherein the control box further comprises a control box water outlet connector;
- wherein the inflatable pool further comprises a back hole formed through the accommodating wall and a pool water outlet connector extending through the inner wall and extending through the back hole; and
- wherein the pool wall water outlet connector is sealed to the control box water outlet connector by the water outlet sealing assembly.

8. The inflatable pool according to claim 6, further comprising:
- a water inlet sealing assembly sealing the pool wall water inlet to the control box water inlet;
- wherein the control box comprises a control box water inlet connector;

wherein the inflatable pool comprises a back hole formed through the accommodating wall and a pool water inlet connector extending through the inner wall and extending through the back hole; and wherein the pool water inlet connector is sealed to the control box water inlet connector by the water inlet sealing assembly.

9. The inflatable pool according to claim 1, wherein the inner wall comprises a pool wall air inlet;

wherein the control box comprises a control box air inlet in communication with the pool wall air inlet; and wherein the control box is configured to supply air into a water receptacle, defined by the inner wall and the pool bottom, via the control box air inlet and the pool wall air inlet.

10. The inflatable pool according to claim 9, further comprising:

an air inlet sealing assembly sealing the pool wall air inlet to the control box air inlet;

wherein the control box further comprises a control box air inlet connector;

wherein the inflatable pool further comprises a back hole formed through the accommodating wall and pool wall air inlet connector extending through the back hole; and wherein the pool air inlet connector is sealed to the control box air inlet connector by the air inlet sealing assembly.

11. The inflatable pool according to claim 1, further comprising:

an inflation sealing assembly;

wherein the control box comprises a control box inflation connector; and wherein the accommodating wall comprises an accommodating cavity inflation connector sealed to the control box inflation connector via the inflation sealing assembly.

12. The inflatable pool according to claim 11, wherein the accommodating cavity inflation connector comprises a first connection part; and wherein the control box inflation connector comprises an inflation insertion end sleeved into the first connection part such that an inner wall of the first connection part is sealed to an outer wall of the inflation insertion end.

13. The inflatable pool according to claim 12, wherein the inflation sealing assembly comprises:

a first inflation clamping groove formed in the inner wall of the first connection part, a first inflation sealing ring disposed in the first inflation clamping groove, a second inflation clamping groove formed in the outer wall of the inflation insertion end, and a second inflation sealing ring disposed in the second inflation clamping groove.

14. An inflatable pool comprising:

a pool body comprising: a pool wall and a pool bottom which together define an inflatable chamber therein, and an accommodating cavity disposed within the pool wall and isolated from the inflatable chamber;

an accommodating wall connected to the pool wall;

a control box disposed in the accommodating cavity, the control box comprising a control box inflation connector;

an inflation sealing assembly; and wherein the accommodating wall comprises an accommodating cavity inflation connector sealed to the control box inflation connector via the inflation sealing assembly.

15. An inflatable pool comprising:

a top wall;

a pool bottom;

an outer wall connected to the top wall and the pool bottom;

an inner wall connected to the top wall and the pool bottom, the inner wall including a pool wall water inlet and a pool wall water outlet;

an inflatable chamber defined by the top wall, the pool bottom, the outer wall and the inner wall;

an accommodating wall connected to the inner wall and to the outer wall;

an accommodating cavity defined by the accommodating wall and isolated from the inflatable chamber;

a control box disposed in the accommodating cavity and including a control box water inlet, in communication with the pool wall water inlet, a control box water outlet, in communication with the pool wall water outlet, and a control box water outlet connector;

a water outlet sealing assembly sealing the pool wall water outlet to the control box water outlet;

wherein the control box is configured to circulate water in a water receptacle, defined by the inner wall and the pool bottom, via the control box water inlet, the pool wall water inlet, the control box water outlet, and the pool wall water outlet;

wherein the inflatable pool further comprises a back hole formed through the accommodating wall and a pool water outlet connector extending through the inner wall and extending through the back hole; and wherein the pool wall water outlet connector is sealed to the control box water outlet connector by the water outlet sealing assembly.

* * * * *